US008752720B1

(12) United States Patent
Habig et al.

(10) Patent No.: US 8,752,720 B1
(45) Date of Patent: Jun. 17, 2014

(54) MOLDED TETHER FOR A VESSEL COVER SYSTEM AND A METHOD OF FORMING

(71) Applicant: Target Brands, Inc., Minneapolis, MN (US)

(72) Inventors: Michael M. Habig, Minneapolis, MN (US); Rachel Ann Jones, Minneapolis, MN (US); Richard P. Riedel, Blaine, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/741,162

(22) Filed: Jan. 14, 2013

(51) Int. Cl.
*B65D 55/16* (2006.01)

(52) U.S. Cl.
USPC ..... 215/306; 220/375

(58) Field of Classification Search
USPC ..... 220/375, 845–847, 740; 215/237, 238, 215/306
See application file for complete search history.

(56) References Cited

U.S. PATENT DOCUMENTS

| | | | | |
|---|---|---|---|---|
| 3,188,036 | A | 6/1965 | Sprung | |
| 4,420,092 | A | 12/1983 | Finkelstein | |
| 4,526,289 | A * | 7/1985 | Schiemann | 220/304 |
| 4,669,641 | A | 6/1987 | Holmes | |
| 4,753,358 | A | 6/1988 | Virca et al. | |
| 5,605,241 | A | 2/1997 | Imperioli | |
| D391,448 | S | 3/1998 | Winer et al. | |
| 5,878,898 | A | 3/1999 | Shefflin | |
| 5,881,774 | A | 3/1999 | Utterberg | |
| 6,079,589 | A * | 6/2000 | Matsuyama et al. | 220/715 |
| D449,092 | S | 10/2001 | Brog et al. | |
| 6,302,286 | B1 | 10/2001 | Witherspoon | |
| D478,005 | S | 8/2003 | Sali | |
| 7,040,499 | B1 | 5/2006 | Reif | |
| D528,910 | S | 9/2006 | Kingsley | |
| D530,200 | S | 10/2006 | Kingsley | |
| D537,676 | S | 3/2007 | Kingsley | |
| 7,419,067 | B2 | 9/2008 | Bouie et al. | |
| D596,458 | S | 7/2009 | McKinney | |
| D605,942 | S | 12/2009 | Miksovsky | |
| D610,005 | S | 2/2010 | McKinney | |
| D619,001 | S | 7/2010 | McKinney | |

(Continued)

OTHER PUBLICATIONS

Office Action from Canadian Patent Application No. 2,801,966, mailed Mar. 27, 2013 (2 pages).

*Primary Examiner* — Fenn Mathew
*Assistant Examiner* — James N Smalley
(74) *Attorney, Agent, or Firm* — Griffiths & Seaton PLLC; JoAnn M. Seaton

(57) ABSTRACT

A molded tether for coupling a cover to a bottle includes a primary ring, a flexible strap, and a bent portion. The primary ring is configured to be attached to a neck of the bottle. The flexible strap is configured to be coupled to the cover. The bent portion extends from the primary ring and couples the primary ring to the flexible strap. The bent portion has a higher level of rigidity than the flexible strap. The bent portion includes a flange and a depending tab. The flange extends radially outwardly from the primary ring. The depending tab extends from an end of the flange opposite the primary ring at a downwardly extending angle away from a plane containing the primary ring and toward the flexible strap. When the molded tether is coupled to the bottle and the cover is removed from the bottle, the strap hangs from the primary ring with an initially non-vertical orientation due to the bent portion.

16 Claims, 34 Drawing Sheets

(56) References Cited

U.S. PATENT DOCUMENTS

2002/0027142 A1 3/2002 Klein
2005/0247714 A1* 11/2005 Backes et al. ..... 220/375
2008/0087624 A1 4/2008 Buckley
2009/0134112 A1 5/2009 Reeves
2009/0236341 A1* 9/2009 McKinney et al. ..... 220/375
2010/0314349 A1 12/2010 Chen
2010/0326948 A1 12/2010 Campbell

* cited by examiner

MOLDED TETHER FOR A VESSEL COVER SYSTEM AND A METHOD OF FORMING

BACKGROUND OF THE INVENTION

Drinking vessels are available in a variety of shapes and sizes. Vessel designs often differ based on an intended consumer use. For example, drinking vessels typically used for porting liquids between various locations often include lids to prevent or at least decrease spills during transport. Such lids include one or more access points providing an opening to liquids and can include slidable features disposed over the opening to open or close the vessel during periods of use and/or non-use. Some lids are removable to allow the vessel to be refilled and are secured to the vessel with a screw top or via another suitable coupling mechanism.

SUMMARY OF THE INVENTION

One aspect of the present invention relates to a molded tether for coupling a cover to a bottle. The molded tether comprises a primary ring, a flexible strap, and a bent portion. The primary ring is configured to be attached to a neck of the bottle. The flexible strap is configured to be coupled to the cover. The bent portion extends from the primary ring and couples the primary ring to the flexible strap. The bent portion has a higher level of rigidity than the flexible strap. The bent portion includes a flange and a depending tab. The flange extends radially outwardly from the primary ring. The depending tab extends from an end of the flange opposite the primary ring at a downwardly extending angle away from a plane containing the primary ring and toward the flexible strap. When the molded tether is coupled to the bottle and the cover is removed from the bottle, the strap hangs from the primary ring with an initially non-vertical orientation due to the bent portion. Other molded tether, vessel cover systems, assemblies, and methods are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
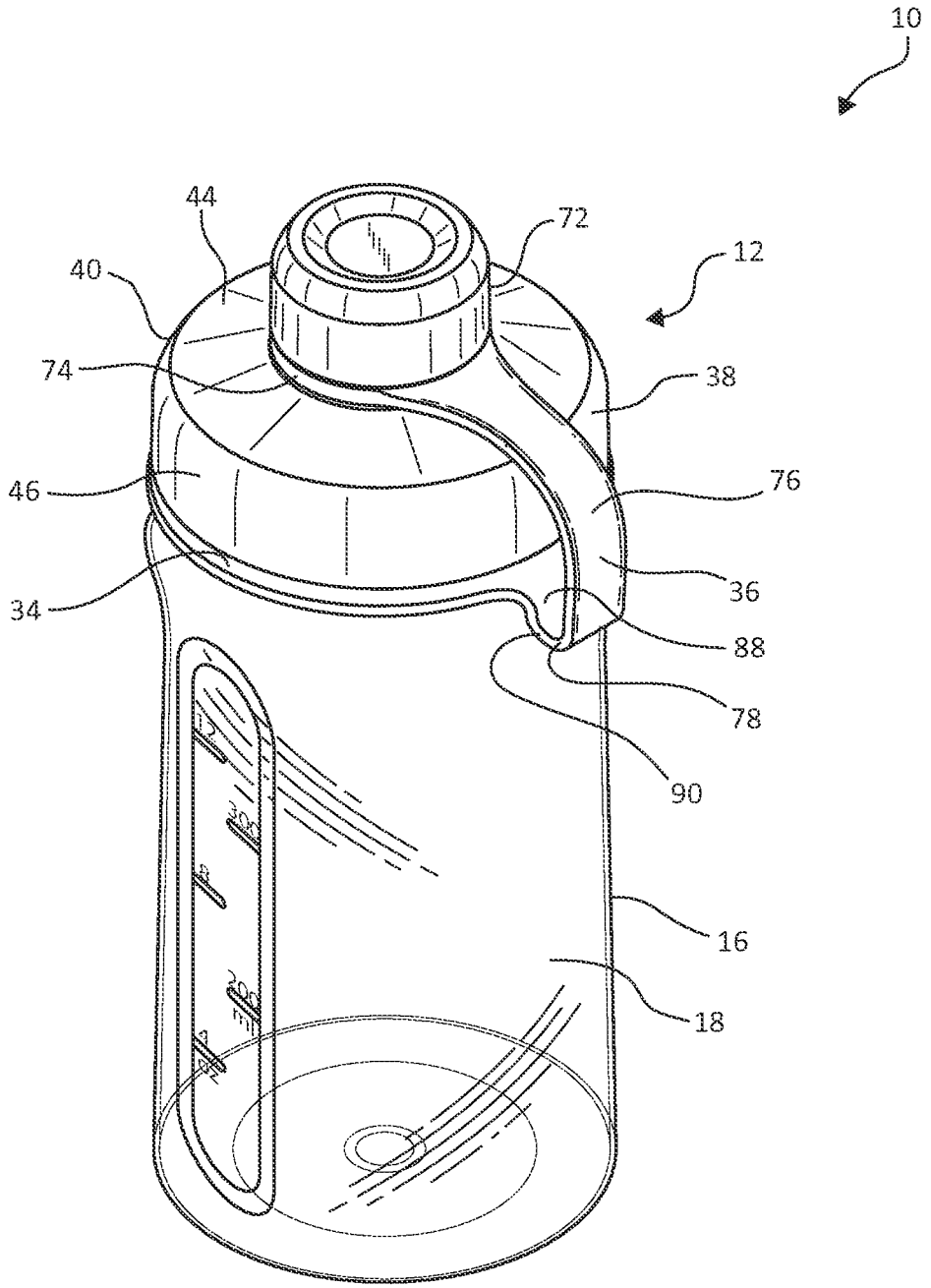
FIG. 1 is a perspective view illustration of a bottle assembly, according to one embodiment of the present invention.
Figure 2:
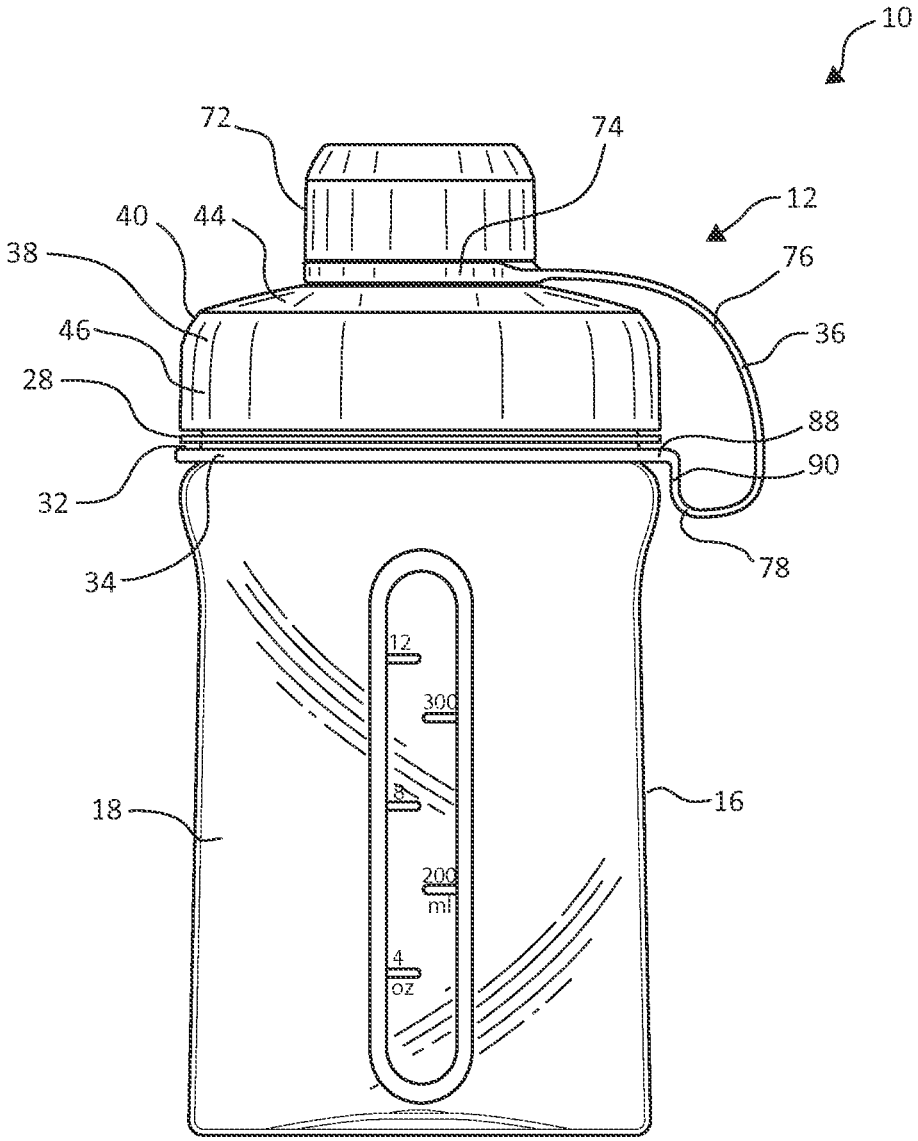
FIG. 2 is a front view illustration of the bottle assembly of FIG. 1, according to one embodiment of the present invention.
Figure 3:
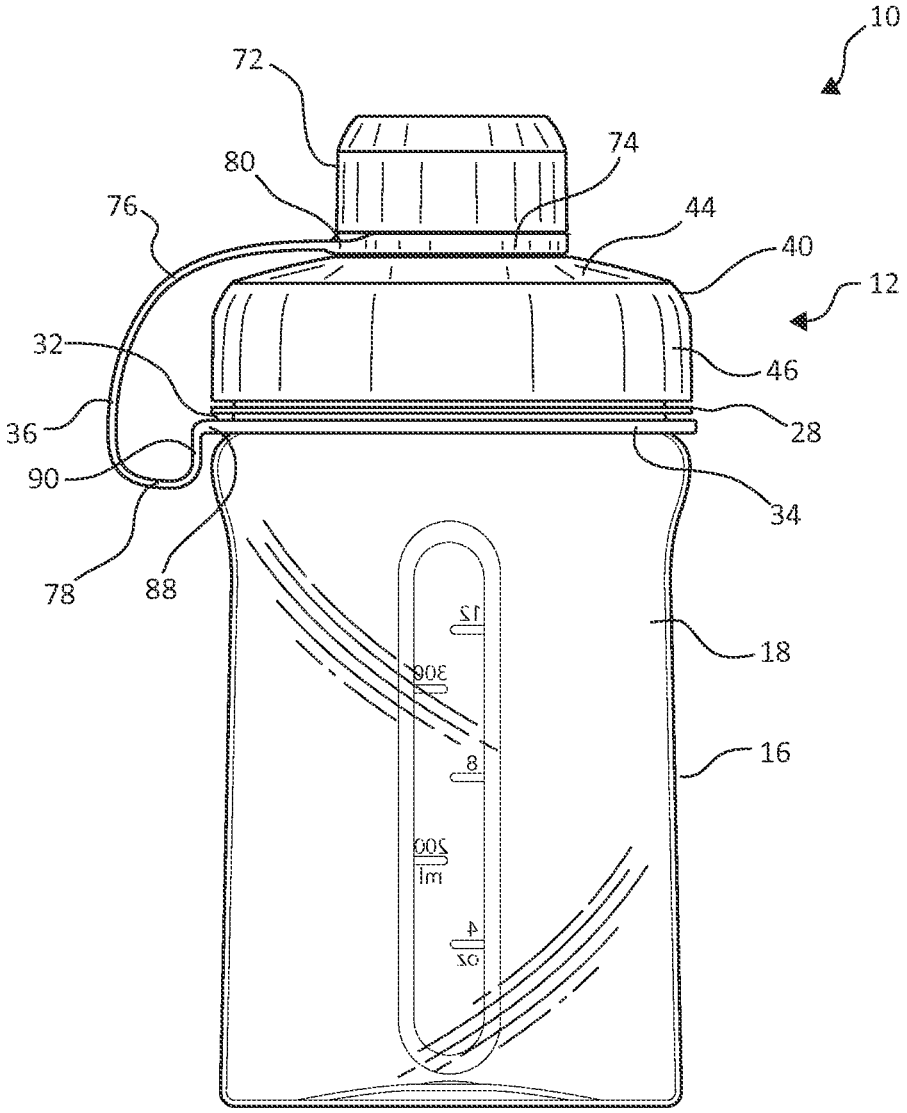
FIG. 3 is a rear view illustration of the bottle assembly of FIG. 1, according to one embodiment of the present invention.
Figure 4:
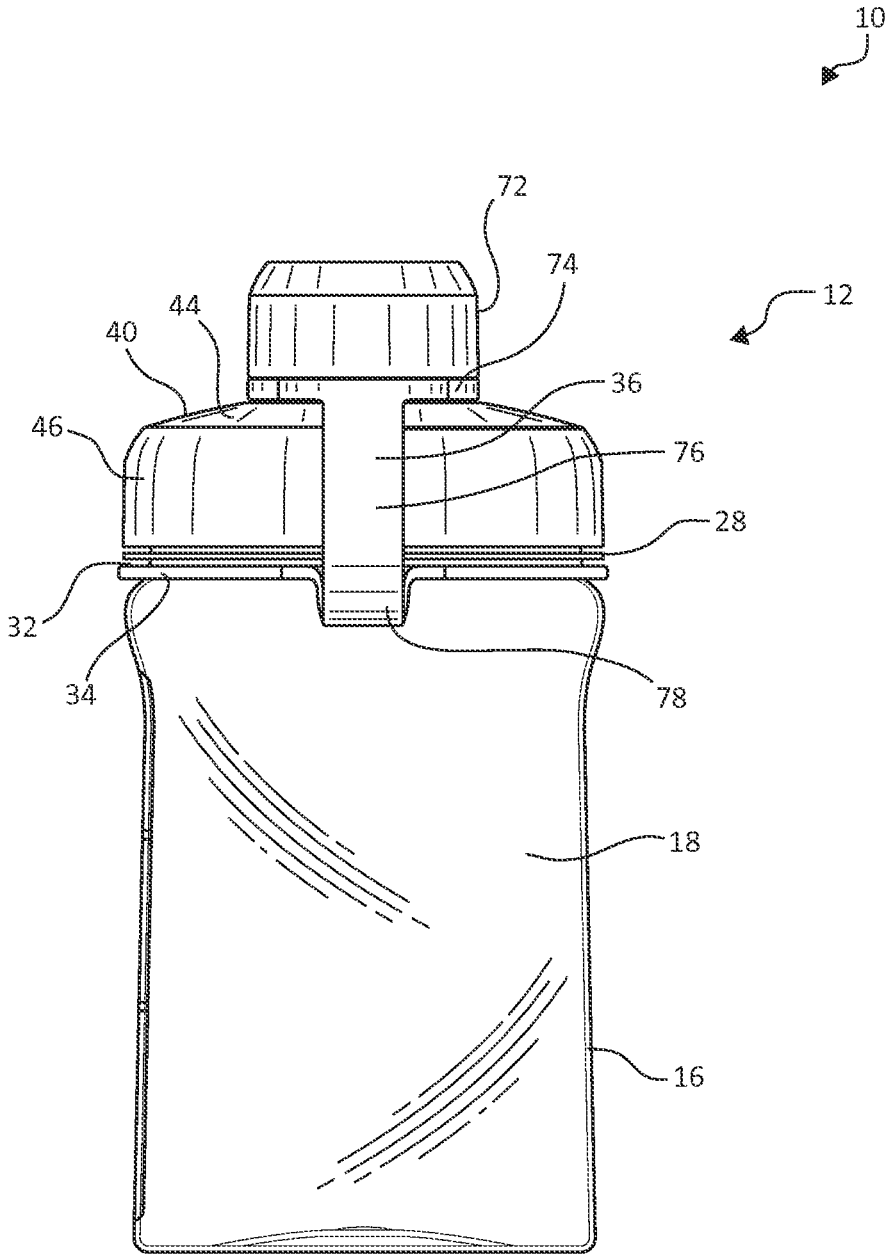
FIG. 4 is a right side view illustration of the bottle assembly of FIG. 1, according to one embodiment of the present invention.
Figure 5:
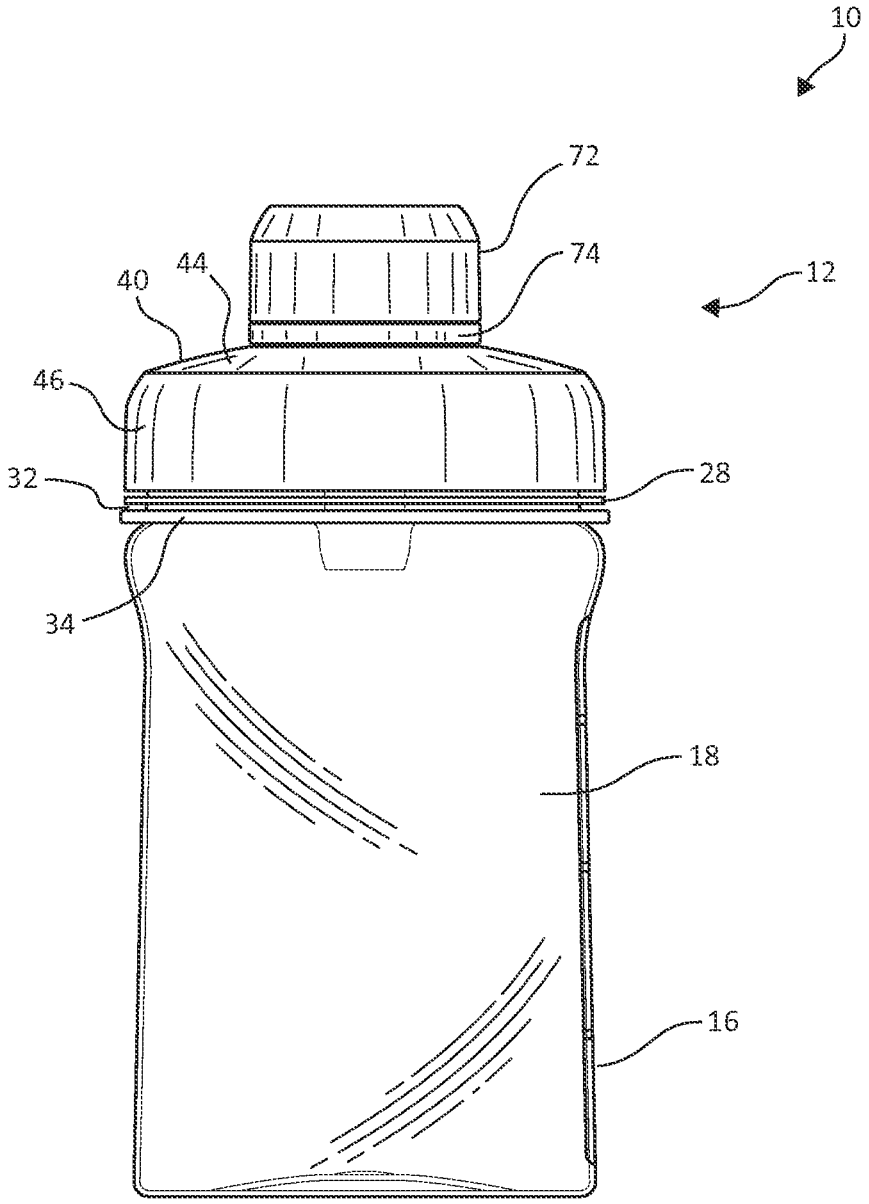
FIG. 5 is a left side view illustration of the bottle assembly of FIG. 1, according to one embodiment of the present invention.
Figure 6:
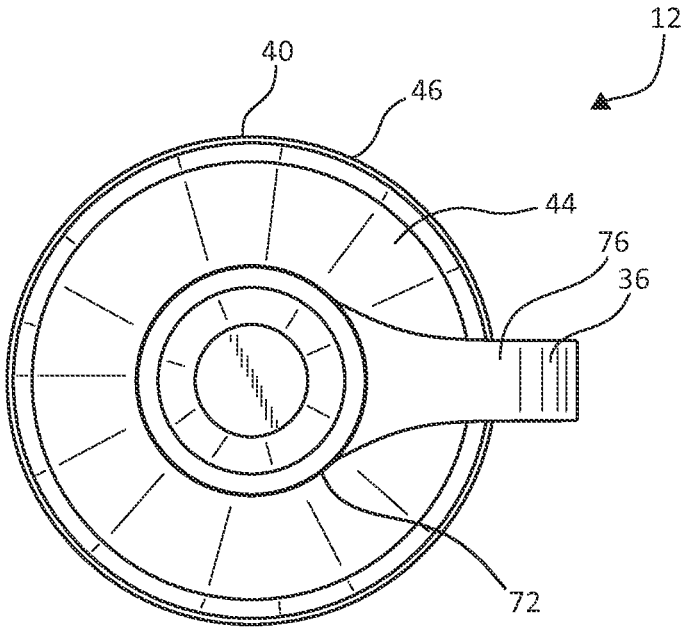
FIG. 6 is a top view illustration of the bottle assembly of FIG. 1, according to one embodiment of the present invention.
Figure 7:
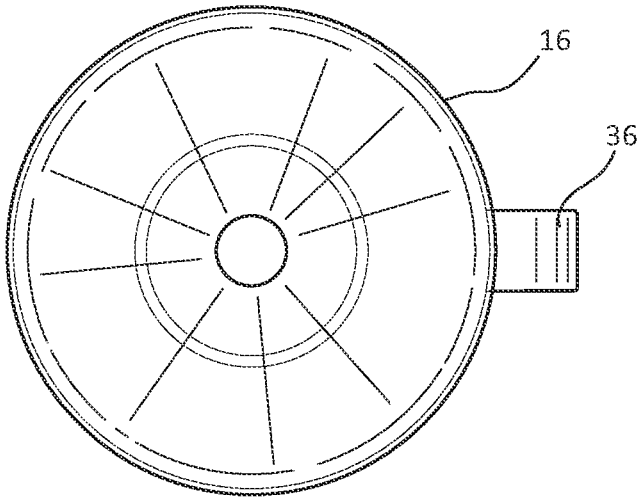
FIG. 7 is a bottom view illustration of the bottle assembly of FIG. 1, according to one embodiment of the present invention.

Embodiments of the present invention provide vessel assemblies including vessels, such as bottles, and vessel cover systems for use therewith. The vessel cover systems conveniently maintain a cap or cover attached to a corresponding vessel via a molded tether. The molded tether is formed to have a preformed bend near the vessel, which allows a user to partake or otherwise pour from the vessel with reduced physical interference from the cap or cover even when the vessel is tilted from an upright to a non-upright position, especially near a users face. In particular, the molded tether is formed such that when the cap or cover of the vessel is removed from the vessel and the vessel is tilted to pour the contents therefrom, the cap or cover is biased to hang or extend substantially downwardly below the vessel due at least in part to the weight of the cap on the tether. Configuring the tether so the cap will hang substantially below the vessel rather than toward a user's face during pouring reduces use frustration caused by cap interference during drinking and, thereby, increases user enjoyment of the corresponding vessel assemblies.

In one embodiment, the molded tether has a primary ring configured to be rotationally attached to a neck of a vessel, a strap extending from the primary ring, a secondary ring extending from an end of the strap opposite the primary ring that is one of removably and statically attached to a cover for the vessel. A bent portion is defined between the primary ring and the strap and is bent and biased to extend outwardly from the primary ring. In one example, the bent portion is a reinforced portion of the molded tether with a substantially L-shape. The molded tether can be used in conjunction with a variety of differently configured vessels, caps, covers, tethers, and vessel assemblies.

With reference now to FIGS. 1-8, a vessel or bottle assembly 10 is illustrated, according to an embodiment. Bottle assembly 10 includes a bottle cover system 12 (otherwise referred to as a vessel cover system) removably coupled to a bottle 16 or other vessel for holding liquids, such as water, juices, coffee, teas, or other drinks or non-consumable items. In one example, bottle 16 is generally lightweight and cylindrical or otherwise tubular (e.g., having a square, rectangle, triangular, or otherwise suitably shaped transverse cross section). Bottle 16 is substantially transparent, in one embodiment, and is formed from a clear or colored transparent or translucent plastic or other suitably sturdy material. Alternatively, bottle 16 is opaque and is formed from aluminum, steel, or another lightweight metallic material. Although bottle 16 is illustrated as a single wall vessel in FIGS. 1-8, in other embodiments, bottle 16 is lined with an insulator, for example, a plastic, or includes a portion forming an insulator such as a plastic interior cavity spaced apart from an outer metallic shell.

With reference to FIGS. 2-5 and 8, bottle 16 includes a main body 18, a neck section 26, and an opening 24. Main body 18 defines a chamber 25 configured to contain a liquid or other suitable consumable. Neck section 26 extends upwardly from main body 18 when in an upright position, and opening 24 is defined through neck section 26 opposite main body 18. In one example, neck section 26 has a smaller outer diameter than an outer diameter of a closest portion of main body 18, and bottle 16 includes an annular transition or retention lip 28 extending radially inwardly from a top of main body 18 to neck section 26. In an embodiment, bottle 16 defines a channel 32 between a lower surface of retention lip 28 and an upper portion of main body 18 for accommodating a portion of bottle cover system 12, as will be further described below. Neck section 26 includes threading 30 (FIG. 8) extending radially outwardly from neck section 26 and in a substantially spiral configuration in a manner configured to selectively receive a corresponding threaded portion of bottle cover system 12, as will be described in more detail below.

Figure 9:
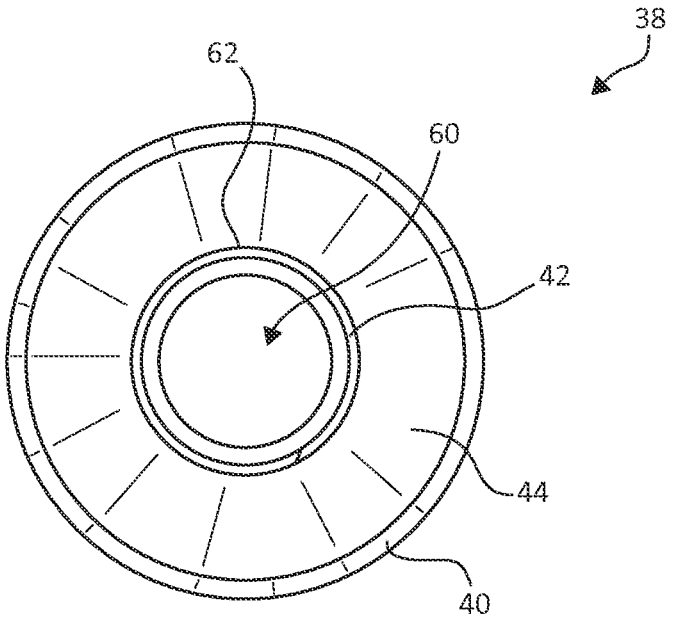
FIG. 9 is a top view illustration of a cover of the bottle assembly of FIG. 7, according to one embodiment of the present invention.
Figure 10:
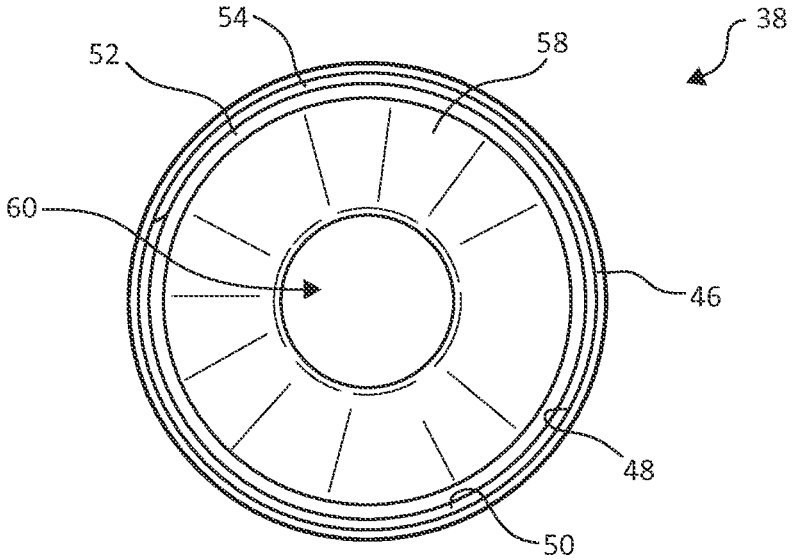
FIG. 10 is a bottom view illustration of the cover of FIG. 8, according to one embodiment of the present invention.

Bottle assembly 10 additionally includes a cover 38 for selectively covering opening 24 of bottle 16 as illustrated with additional reference to the top and bottom cover 28 views of FIGS. 9 and 10. In one example, cover 38 includes a base 40, for covering opening 24 of bottle 16, and a spout 42 extending upwardly therefrom. In one example, spout 42 is eliminated. Base 40 includes a top wall 44 and a sidewall 46 extending downwardly from and substantially entirely around an outer perimeter of top wall 44. Top wall 44 defines a bottom surface 58 configured to face chamber 25 when cover 38 is coupled with bottle 16. Sidewall 46 defines an inner diameter surface 48 having a diameter substantially equal to or slightly greater than an outer diameter of neck section 26 of bottle 16. Inner diameter surface 48 of sidewall 46 includes threading 50 extending radially inwardly therefrom in a substantial spiral configuration corresponding to threading 30 of bottle 16 to allow engagement and disengagement of base 40 with neck section 26 during use.

To provide a substantially water-tight seal when coupled to bottle 16, in one example, base 40 includes an inner annular flange 52 (FIG. 10) extending downwardly from top wall 44 of base 40. Inner annular flange 52 is located radially inwardly from sidewall 46 providing a gap 54 (FIG. 10) sufficiently sized to accommodate at least a thickness of a wall of bottle 16. Additionally, inner annular flange 52 is configured to extend partially into opening 24 when main cover 38 is coupled to bottle 16. Thus, when main cover 38 is placed over bottle opening 24 and rotated in a direction (e.g., clockwise) to secure main cover 38 on bottle 16, a topmost edge 56 of bottle 16 forms a leak tight seal against bottom surface 58 of top wall 44 and an inner diameter of inner annular flange 52 contacts an inner surface of bottle 16. In one example, inner annular flange 52 is eliminated.

In one example, cover 38 includes a spout 42 extending upwardly from base 40. Spout 42 is open through base 40 to provide access to a consumable stored in bottle 16 through spout 42 and defines a spout opening 60 opposite base 40. Spout 42 is, in one example, smaller than opening 24 to provide more restrictive access to the consumable in bottle 16, which, in one instance, provides for easier drinking from or pouring of contents of bottle 16 during use and/or to minimize inadvertent spilling during storage, use, and transport. Spout 42 defines an outer surface 62 having a non-threaded portion 64 and a threaded portion 66. Non-threaded portion 64, which extends along a top half of spout 42, is defined by a substantially smooth surface for providing comfortable contact surface for the user when the user drinks from spout 42. Threaded portion 66 is formed on a bottom half of spout 42 in a substantially spiral or other suitable configuration.

In an embodiment in which cover 38 includes spout 42, bottle cover system 12 includes a cap 72 configured to fit over and cover spout 42. Cap 72 includes threading 68 on an inner surface (not shown) thereof as will be apparent to those of skill in the art upon reading this application to correspond with threaded portion 66 of spout 42. Accordingly, cap 72 is, in one instance, rotatably and selectively secured to spout 42. In one example, cap 72 includes an annular channel 84 defined adjacent an outer surface of cap 72 around its entire circumference. Annular channel 84 is defined, in part, and capped by a wall 92 also defining an annular lip 94 along a lowermost portion of cap 72. Annular channel 84 has a diameter that is substantially equal to or slightly smaller than the inner diameter of cap ring 74 and a depth that is substantially equal to or less than a radial thickness of cap ring 74.

Figure 8:
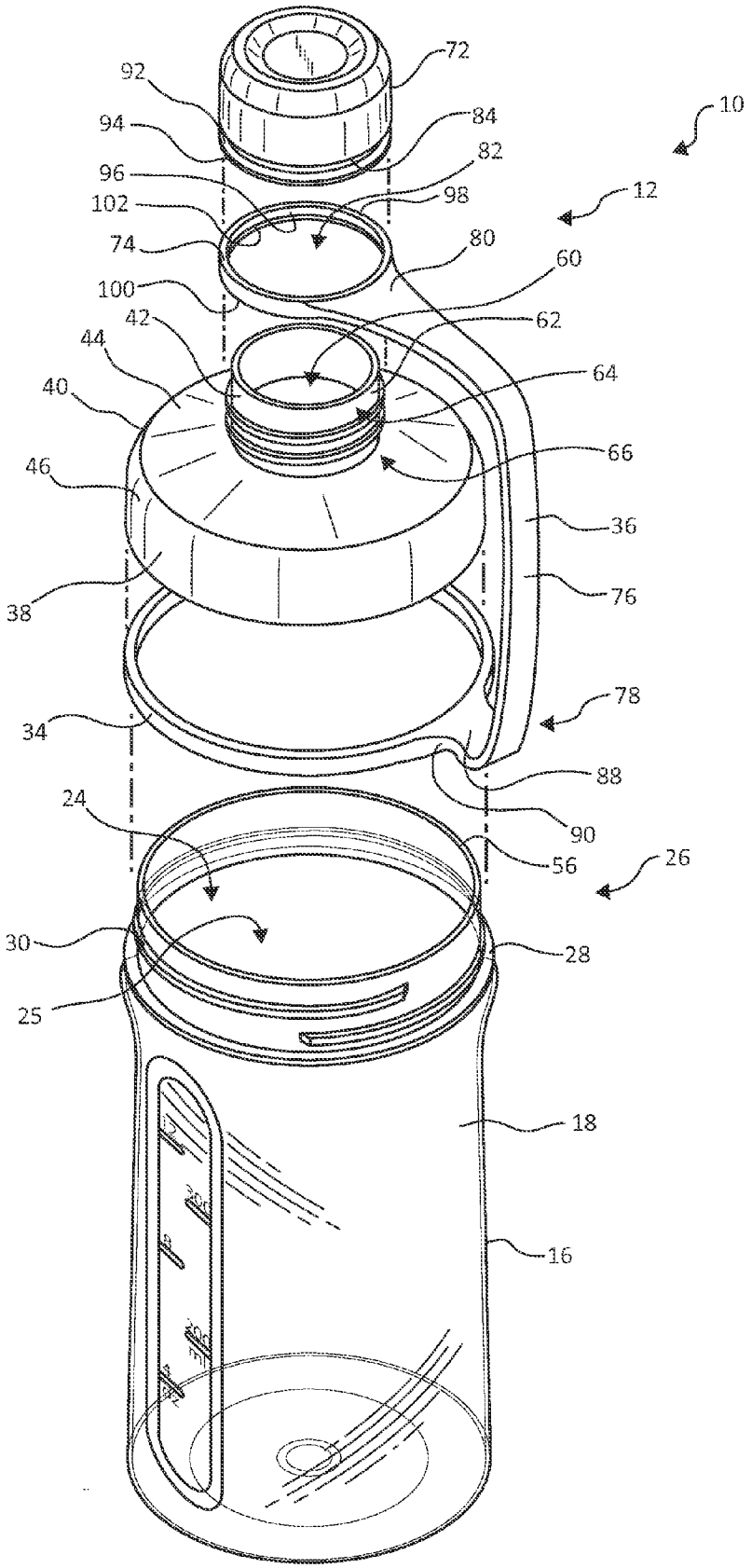
FIG. 8 is an exploded view illustration of the bottle assembly of FIG. 1, according to one embodiment of the present invention.
Figure 11:
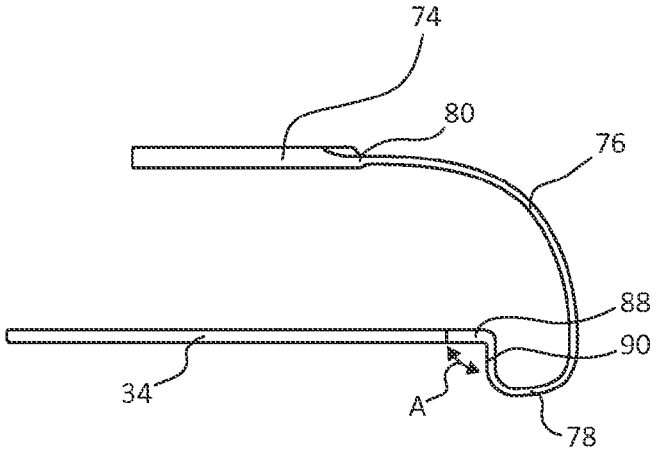
FIG. 11 is a right side view illustration of a tether of the bottle assembly of FIG. 7, according to one embodiment of the present invention.

Referring primarily to FIGS. 8 and 11, in one example, bottle cover system 12 includes a molded tether 36 configured to at least temporarily attach cap 72 to bottle 16 (and cover 38 to bottle 16 via cap 72) and including a primary or vessel ring 34, a secondary or cap ring 74 opposite vessel ring 34, a strap 76 extending between and coupled to each of vessel ring 34 and cap ring 74, and a bent portion 78.

Vessel ring 34 is sized to fit and be selectively retained within channel 32 of bottle 16 and, thus, has an inner diameter that is greater than a smallest diameter of the portion of bottle 16 defining channel 32. In one example, vessel ring 34 has a thickness that is less than a height of channel 32. In one embodiment, vessel ring 34 is at least partially elasticized such that vessel ring 34 is stretchable to fit over retention lip 28 while returning to its original smaller shape to hold main body 18 in channel 32. In one example, vessel ring 34 is sized to maintain bottle 16 but relatively easily rotate within channel 32 relative to a central axis of bottle 16. Vessel ring 34 has an outer diameter that is substantially equal to the outer diameter of retention lip 28 to provide a uniform appearance upon construction of bottle assembly 10. In another embodiment, the outer diameter of vessel ring 34 is slightly larger than that of retention lip 28, but smaller than the outer diameter of the nearest portion of bottle 16.

In one example, cap ring 74 is also partially elasticized allowing stretch for assembly with cap 72. In one instance, cap ring 74 is less elastic than vessel ring 34. Cap ring 74 is coupled to an end 80 of strap 76 opposite vessel ring 34. Cap ring 74 is integrally formed as part of strap 76 as illustrated or, alternatively, is a separate component that is attached to end 80 of strap 76. In another embodiment, cap ring 74 has a suitable width to define a circular opening 82 therethrough capable of accommodating cap 72. Cap ring 74 has an inner diameter that is substantially equal to an outer diameter of annular channel 84 formed in cap 72 for accommodating cap ring 74.

Because the user may repeatedly handle cap 72 during use of assembly 10 and hence, cap ring 74 is manipulated more frequently than vessel ring 34, in one example, cap ring 74 has a more robust configuration than vessel ring 34. For instance, cap ring 74 is twice as thick as, or generally thicker than, vessel ring 34. Additionally or alternatively, cap ring 74 is less pliable or elastic than vessel ring 34 and/or is formed from an entirely different, rigid material than vessel ring 34 and strap 76.

Referring primarily to FIG. 8, cap ring 74 defines an interior surface 96 for facing outer surfaces of cap 72 in annual channel 84 and extending between a top surface 98 and a bottom surface 100 of cap ring 74. In one embodiment, interior surface 96 includes an annular indentation 102 extending radially inwardly from bottom surface 100 of cap ring 74 and upwardly extending about half way along interior surface 96 toward bottom surface 100. Portions of interior surface 96 other than annular indentation 102 define a first inner diameter of interior surface 96 substantially equal to a smallest outer diameter of annular channel 84. Annular indentation 102 defines a second inner diameter that is greater than the outer diameter of annular lip 94 of cap 72. Thus, top surface 98 of cap ring 74 is aligned with annular lip 94 of cap 72 and then is relatively easily slipped over annular lip 94 such that annular indentation 102 receives annular lip 94 in a manner securing a remainder of cap ring 74 within annular channel 84. In one example, bottom surface 100 of cap ring 74 aligns with and/or surrounds a lower surface of annular lip 94 when cap ring 74 is secured by annular channel 84.

Strap 76 connects vessel ring 34 to cap ring 74 and is generally an elongated flexible strip of a suitable material, such as the same material forming vessel ring 34 and cap ring 74, in one embodiment. In one example, strap 76 is substantially uniform in width and has a length configured to provide cap 72 with clearance from a user's face when a user drinks from spout 42. Although strap 76 is illustrated as having a length that is shorter than a height of bottle 16, strap 76 is configured to be longer than the height of bottle 16 in alternate embodiments. The thickness of strap 76 allows strap 76 to be repeatedly bent and straightened without substantially degrading the integrity of strap 76 as cap 72 is repeatedly placed on cover 38 for storage and removed from cover 38 for drinking or pouring from spout 42.

Bent portion 78 is formed between strap 76 and vessel ring 34 and, in one example, is configured to bias strap 76 (at least a portion of strap 76 closest to vessel ring 34) away from cover 38 and spout 42. In this regard, bent portion 78 is a reinforced, permanently molded, substantially rigid L-shaped portion that extends between vessel ring 34 and strap 76 such that vessel ring 34 and strap 76 extend substantially perpendicularly to one another when molded tether 36 is left in its molded or natural position (see FIG. 12) without interference from external forces. According to an embodiment, the L-shaped feature is defined by a narrow projection 88 (otherwise referred to as a first planar leg or radial extension) extending from vessel ring 34 and a leg or flange 90 (otherwise referred to as a second planar leg or a depending extension) extending from projection 88 to strap 76. Projection 88 is molded as a substantially rectangular extension of vessel ring 34. Alternatively, projection 88 is tapered, being wider at points closer to vessel ring 34 than at points further away from vessel ring 34 or vice versa. Projection 88 resides in substantially the same plane as vessel ring 34. In an embodiment, projection 88 is substantially equal in thickness to vessel ring 34. Alternatively, projection 88 and/or flange 90 are thicker than one or both of vessel ring 34 and strap 76 such that bent portion 78 more effectively maintains a natural bias to its original L-shaped position. To prevent strap 76 from contacting or at least decrease the occurrences in which strap 76 contacts bottle 16 when user removes cap 72 from bottle 16 during use, an outermost edge of projection 88 extends a distance away from vessel ring 34 suitable for allowing strap 76 to extend radially away from bottle 16.

As briefly noted above, flange 90 extends from projection 88. Flange 90 extends downwardly from the outermost edge of projection 88 at a substantially perpendicularly angle A (FIGS. 11 and 12) with respect to flat projection 88. Angle A is, in one example, substantially equal to between about 45 degrees and 135 degrees, for example, about 90 degrees. In an embodiment, flange 90 is substantially inflexible relative to strap 76 and is defined by a reinforced or thicker portion of strap 76 immediately adjacent projection 88. Because flange 90 extends substantially perpendicularly relative to projection 88, all or at least a portion of strap 76 extends in a different plane from vessel ring 34.

In one example, vessel ring 34, strap 76, and bent portion 78 are formed as a single component from a single piece of injection molded material to form the various portions described above exhibiting different pliability characteristics. In an example, the material is selected so that varying thickness of two or more of vessel ring 34, strap 76, and bent portion 78 changes the stiffness and/or rigidity of those portions. For instance, vessel ring 34 has a material thickness and, therefore, a stiffness that is greater than that of strap 76. In another embodiment, the material is selected to allow bent portion 78 to be formed having a stiffness that is greater than that of vessel ring 34 and strap 76 and to retain its natural, molded L-shape despite frequent deformation of bent portion 78 into a temporary substantially straightened configuration. Suitable materials from which molded tether 36 is formed include, but are not limited to, polypropylene, rubber, plastics, and the like.

Figure 12:
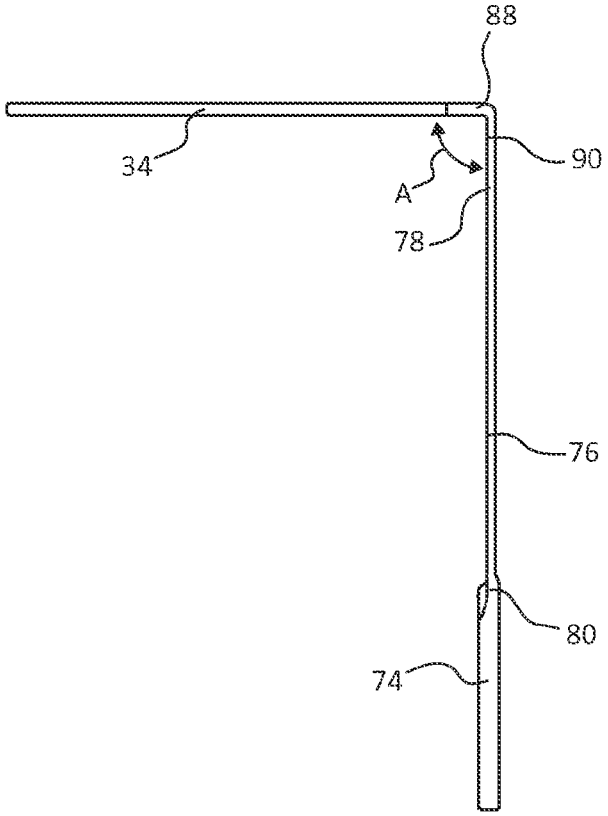
FIG. 12 is a right side view illustration of the tether of FIG. 11 in a molded position, according to one embodiment of the present invention.
Figure 13:
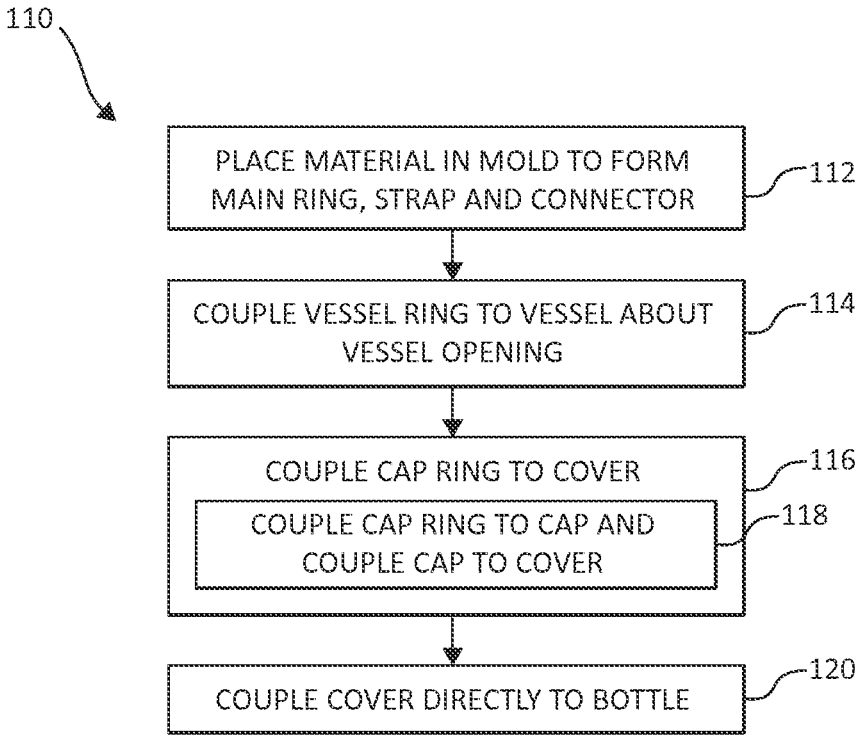
FIG. 13 is a flow diagram illustrating a method of forming a bottle assembly, according to one embodiment of the present invention.

Turning to the flow chart of FIG. 13 as described in view of FIGS. 1-12, a method 110 of forming a bottle cover system, such as bottle cover system 12, is illustrated. After selecting a suitable material, such as polypropylene, plastic, and the like, at 112, the material is placed in a mold to form a molded tether 36 including, for example, vessel ring 34, cap ring 74, strap 76, and bent portion 78. The mold (not shown) is formed with one or more cavities, as will be apparent to those of skill in the art upon reading this application, to form molded tether 36 and all of its associated portions in a molded position as illustrated in FIG. 12. More specifically, in the molded position, strap 76 extends substantially perpendicularly (e.g., at angle A) relative to vessel ring 34. By forming molded tether 36 in the molded position, bent portion 78 of molded tether 36 becomes biased by material memory causing the molded tether 36 to be inclined to return to the original molded position. In one example, the mold is formed to define substantially planar flange 88 to extend in the same plane as vessel ring 34, projection 90 to extends in a plane substantially perpendicular to the plane including vessel ring 34 and substantially planar flange 88, and cap ring 74 to reside substantially in the same plane as projection 90. In one example, the mold is further configured to have various cavity depths to form molded tether 36 with the varying material thicknesses and rigidities described above.

Once molded tether 36 is formed and cooled at 112, then at 114, vessel ring 34 is coupled to bottle 16 about opening 24. More particularly, vessel ring 34 is stretched to fit over retention lip 28 and enter channel 32 of bottle 16. Once moved over retention lip 28, vessel ring 34 returns to it original shape to hold bottle 16 within channel 32 while, in one example, still allowing vessel ring 34 to freely rotate about bottle 16. At 116, cap ring 74 is coupled to cover 38. For example, coupling cap ring 74 to cover 38 at 116 includes, at 118, coupling cap ring 74 to cap 72 by stretching and sliding cap ring 74 over annular lip 94 of cap 72 to place cap ring 74 in annular channel 84 such that annular indentation 102 of cap ring 74 receives annular lip 94 of cap 72. In one embodiment, in which cap 72 is eliminated, operation 118 is eliminated and cap ring 74 is coupled directly to cap 72 as will be apparent to those of skill in the art after reading this application.

At 120, cover 38 is coupled to bottle 16 to cover opening 84 such as via rotatable coupling due to interaction between threading 30 of bottle 16 and threading 50 of cover 38. In this configuration, bottle assembly 10 is ready for transport, storage, sale, and use by consumers and/or retailers.

Figure 14:
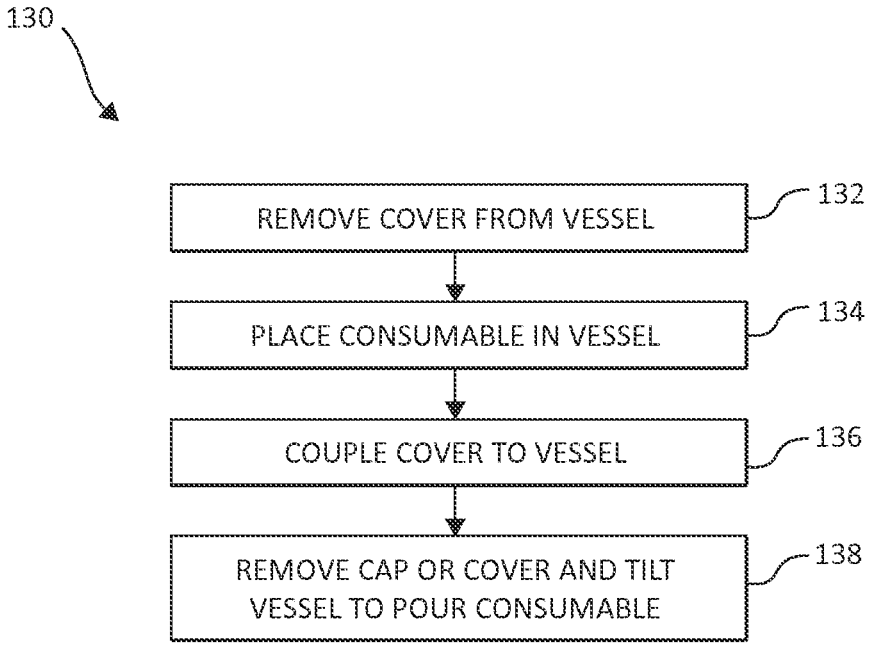
FIG. 14 is a flow diagram illustrating a method of using a bottle assembly, according to one embodiment of the present invention.
Figure 15:
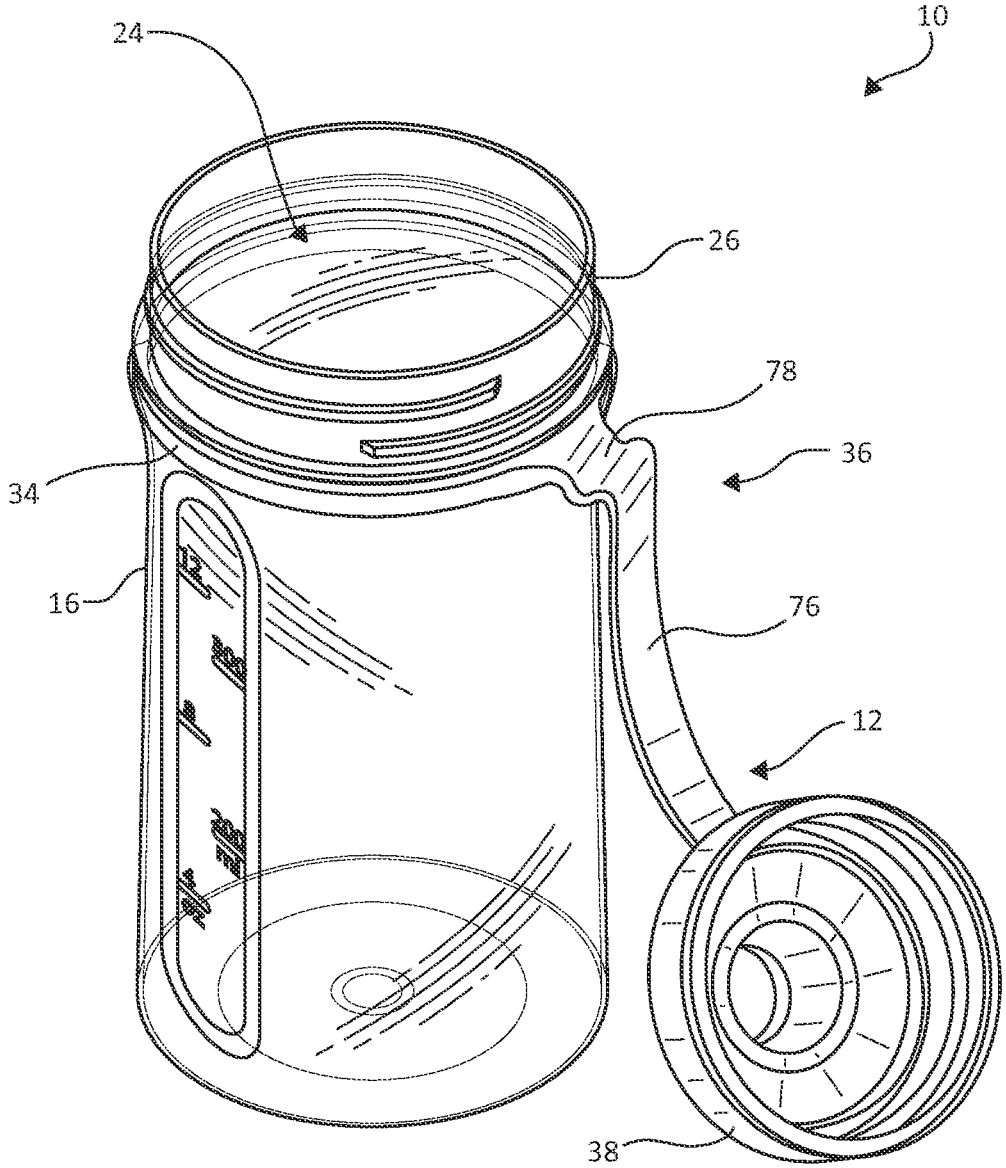
FIG. 15 is a perspective view illustration of a cap and a tether of the bottle assembly of FIG. 1 with the tether folded back, according to one embodiment of the present invention.

FIG. 14 illustrates one embodiment of a method 130 of using bottle assembly 10. First, at 132, cover 38 is removed from bottle 16, e.g., by rotating cover 28 relative to bottle 16 to disengage threading 30 of bottle 16 from threading 50 of cover 38, for example, as shown in FIG. 15. By removing cover 38 rather than cap 72, a larger opening, that is opening 24 of bottle 16 rather than spout opening 60 of spout 42, can be accessed making the next filling operation easier in certain circumstances. As illustrated in FIG. 15, when cover 38 is removed and cap 72 remains coupled to cover 38, molded tether 36 holds cover 38 to bottle 16. More specifically, due to the rigidity and preformed L-shape of connection 78, cover 38 hangs both downwardly and radially away from neck section 26 of bottle 16.

At 134, a suitable consumable, such as a beverage or other pourable liquid, is placed in bottle 16 via opening 84. In another embodiment, at 132, only cap 72 is removed from cover 38 and cover 38 remains on bottle 16, and at 134, the consumable is filed into chamber 25 of bottle via spout 42. Once a desired amount of the consumable is positioned in chamber 25 of bottle 16, cover 38 is recoupled with bottle 16 or, alternatively, cap 72 is replaced over spout 42. With cover 38 and/or cap 72 tightly secured to bottle 16 and/or each other, the consumable is maintained in chamber 25 in a manner allowing for very little if any spilling of consumable from bottle 16.

Figure 16:
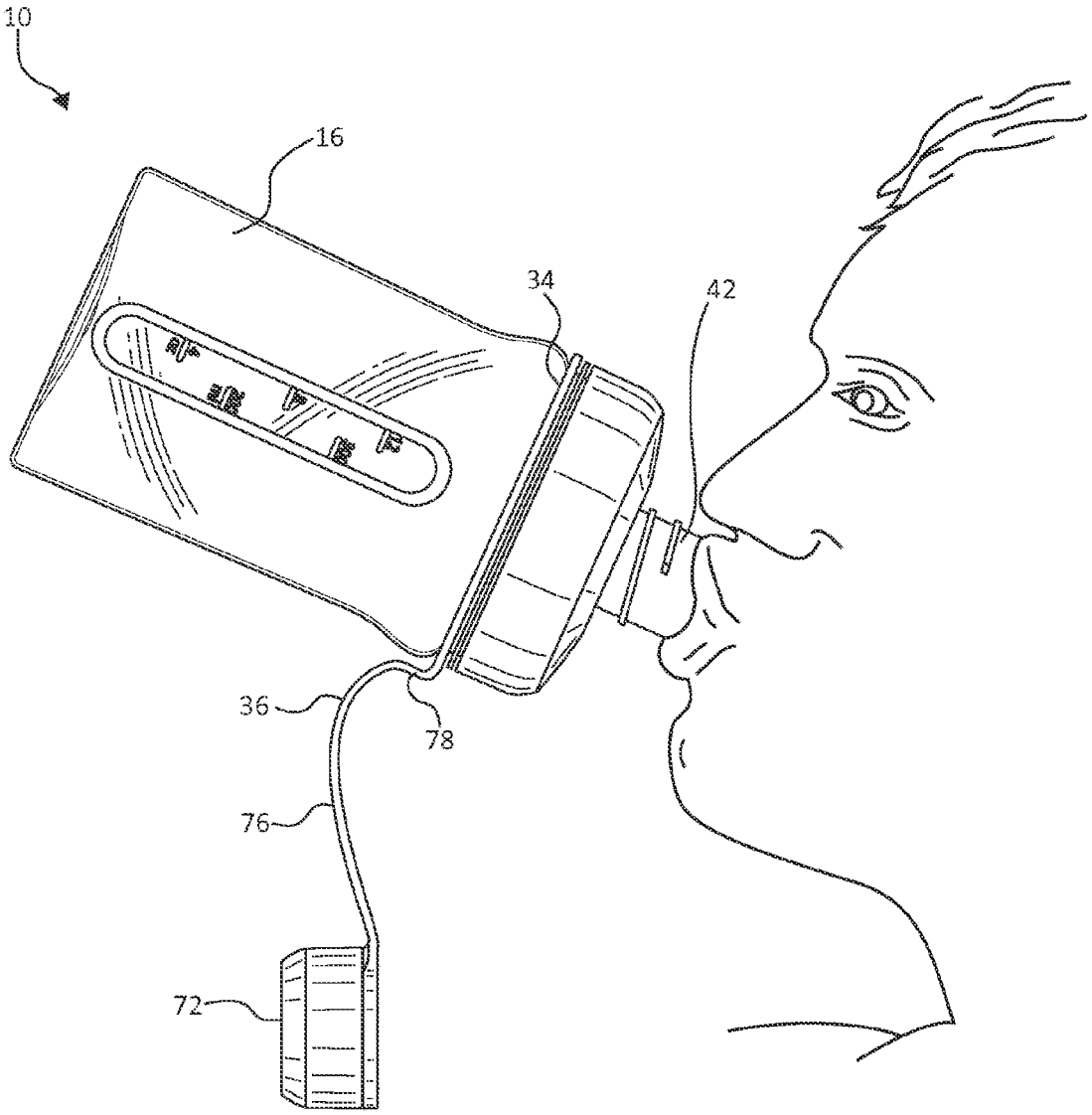
FIG. 16 is a side view illustration of a user drinking from the bottle assembly of FIG. 1, according to one embodiment of the present invention.
Figure 17:
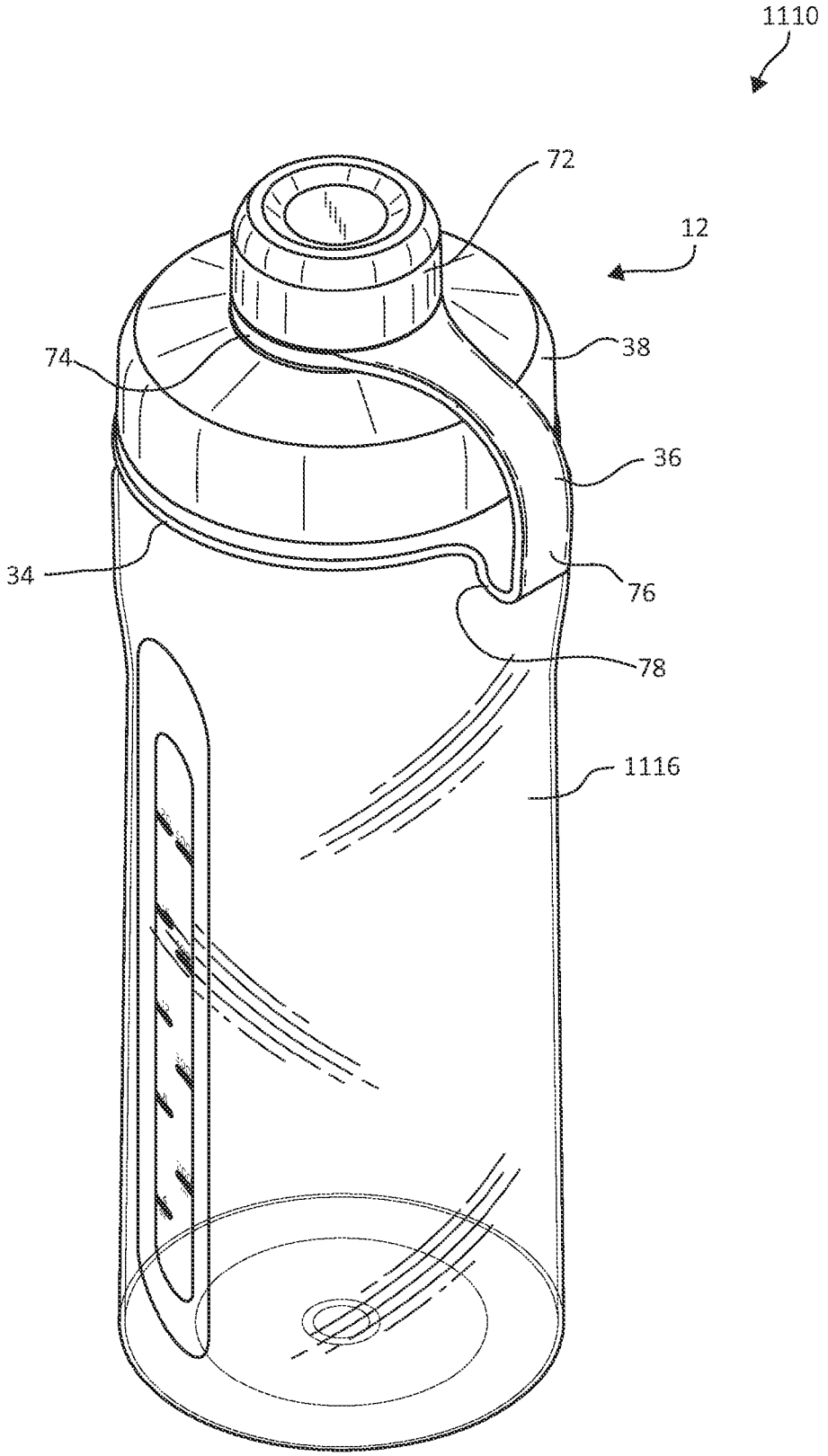
FIG. 17 is a perspective view illustration of a bottle assembly, according to one embodiment of the present invention.
Figure 18:
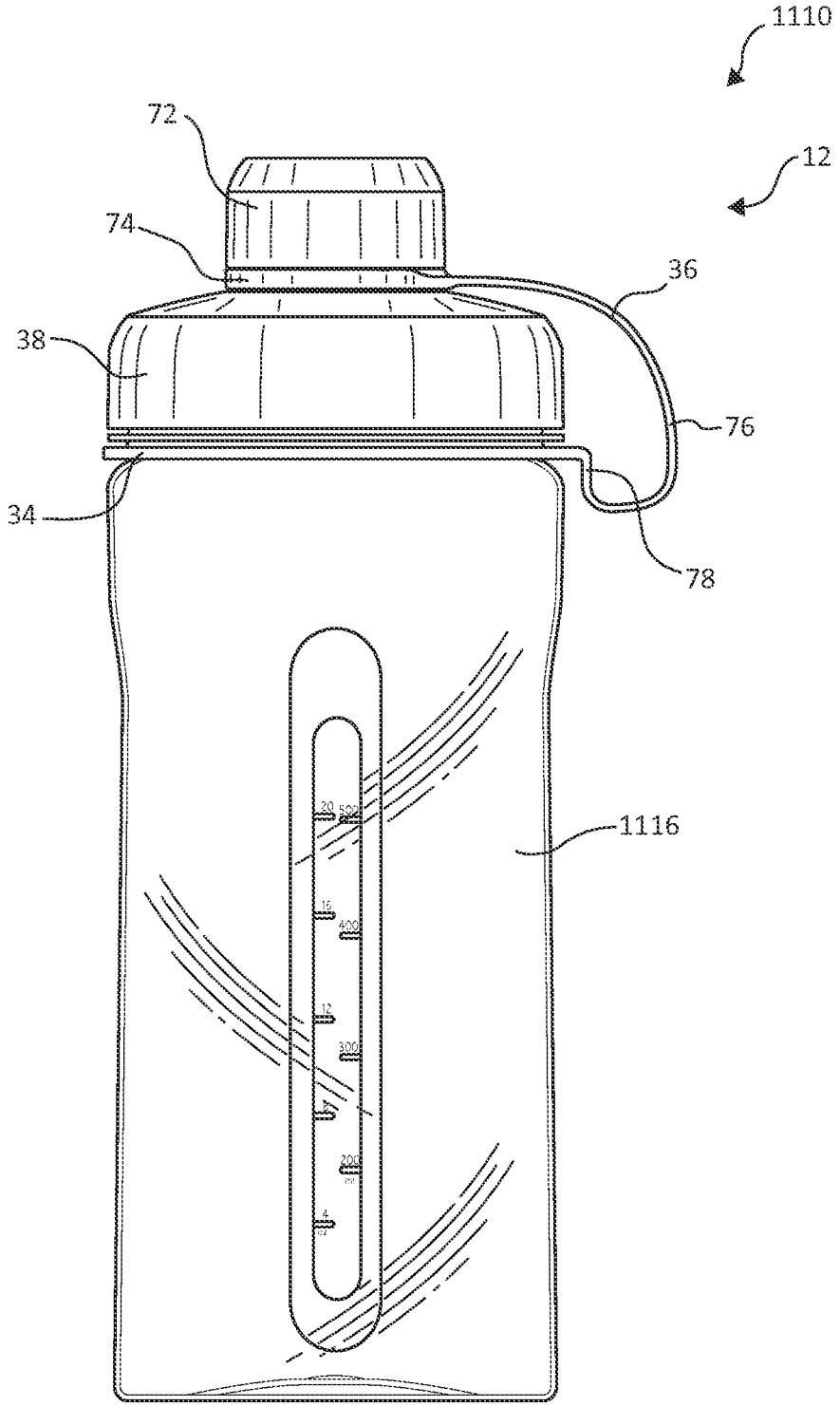
FIG. 18 is a front view illustration of the bottle assembly of FIG. 17, according to one embodiment of the present invention.
Figure 19:
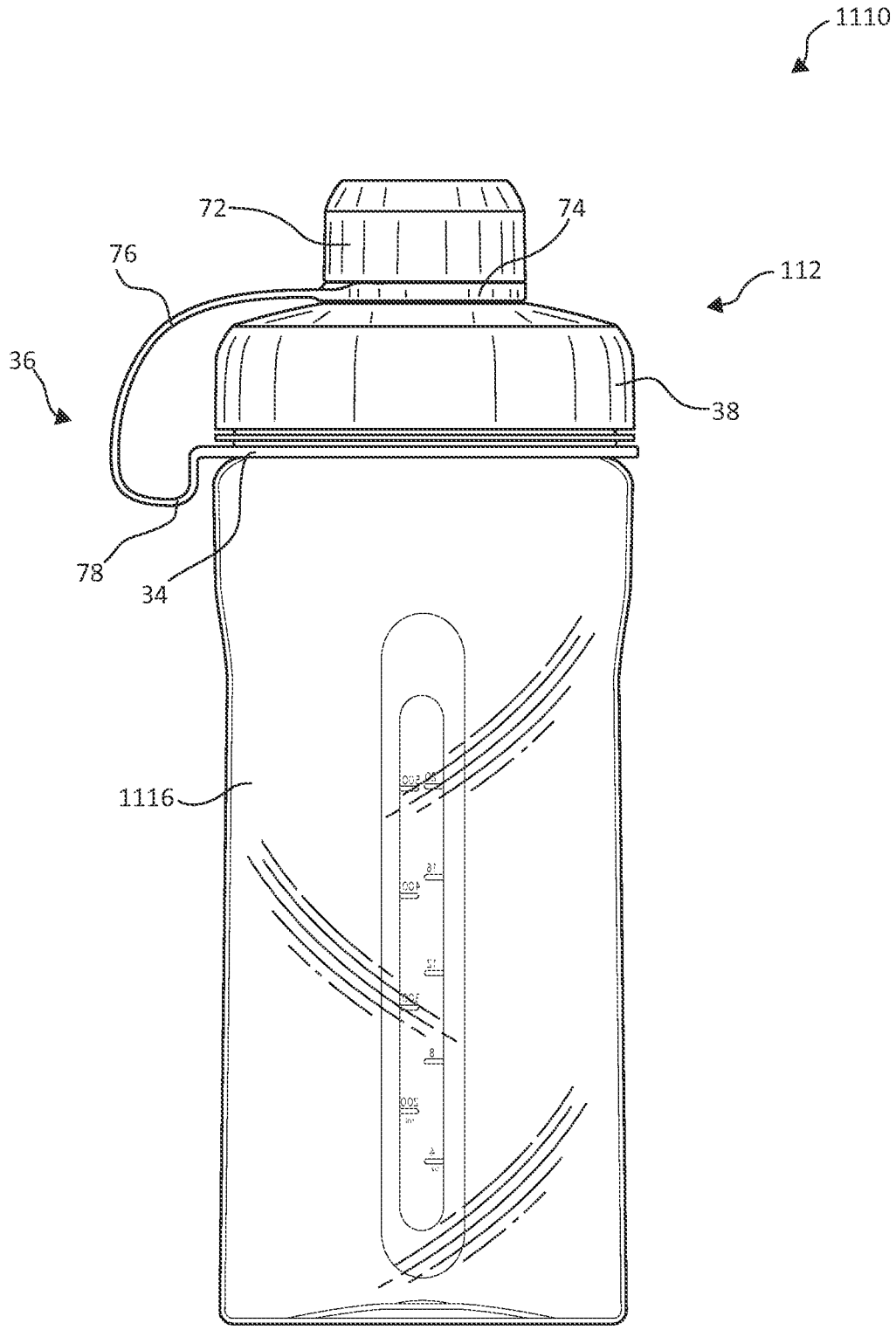
FIG. 19 is a rear view illustration of the bottle assembly of FIG. 17, according to one embodiment of the present invention.
Figure 20:
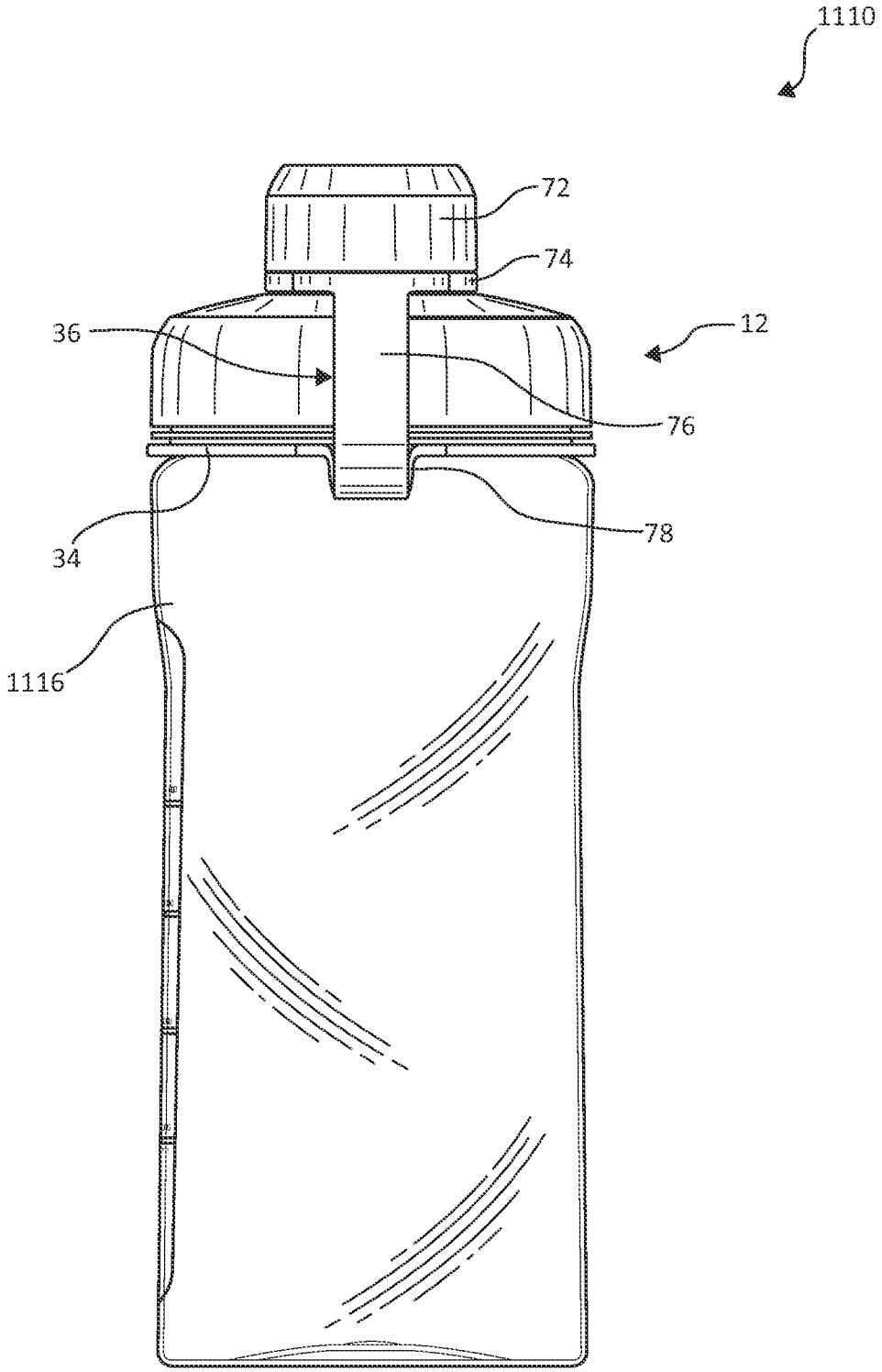
FIG. 20 is a right side view illustration of the bottle assembly of FIG. 17, according to one embodiment of the present invention.
Figure 21:
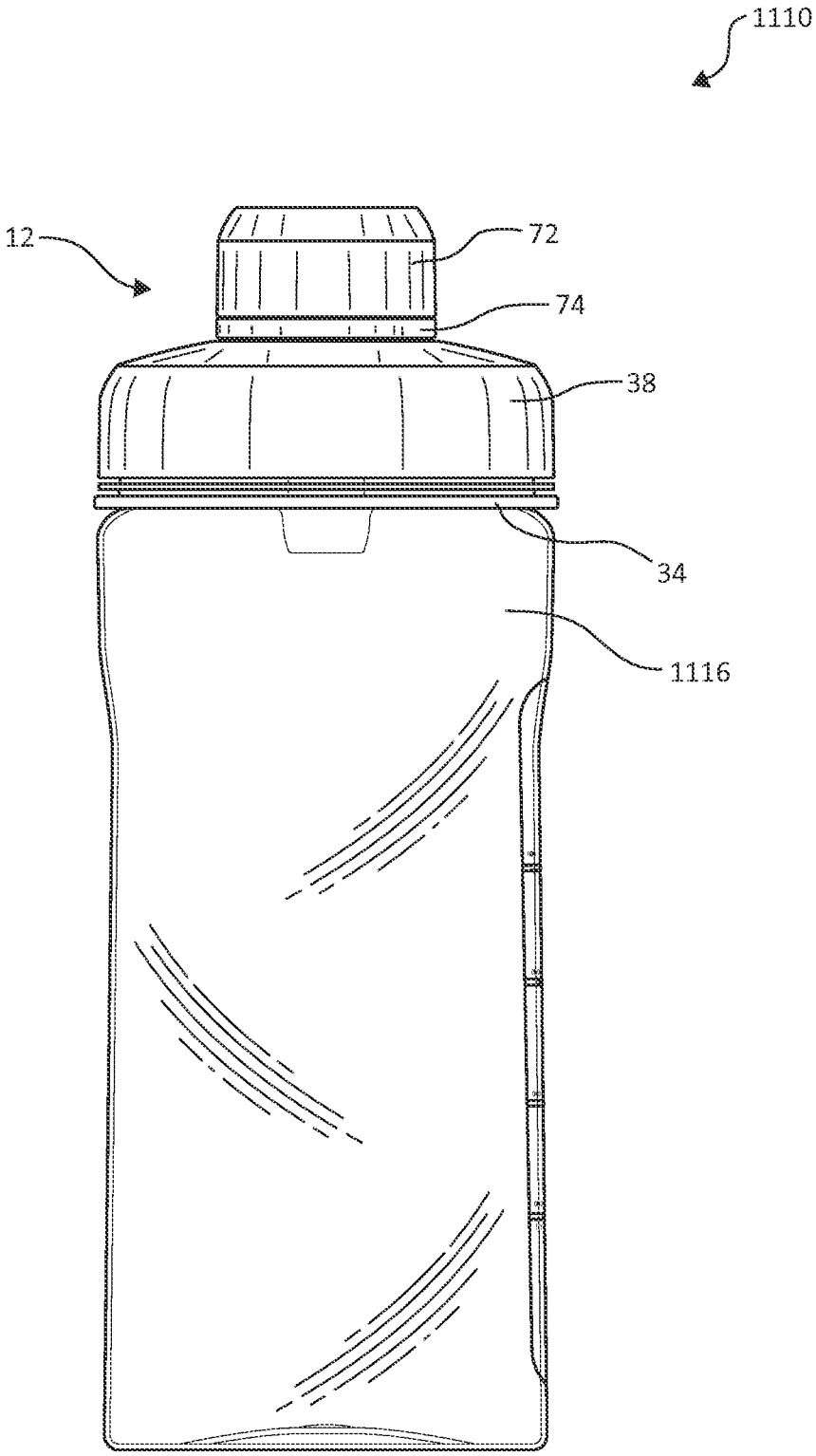
FIG. 21 is a left side view illustration of the bottle assembly of FIG. 17, according to one embodiment of the present invention.
Figure 22:
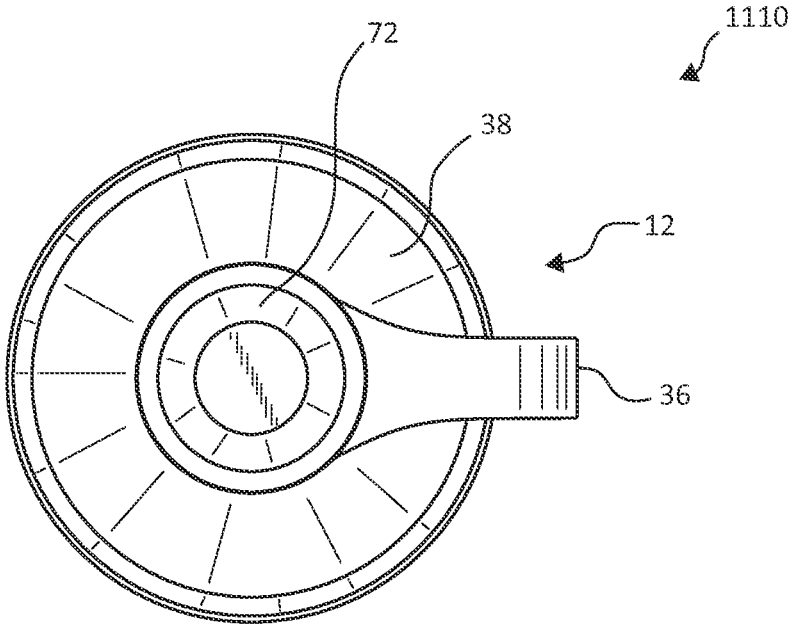
FIG. 22 is a top view illustration of the bottle assembly of FIG. 17, according to one embodiment of the present invention.
Figure 23:
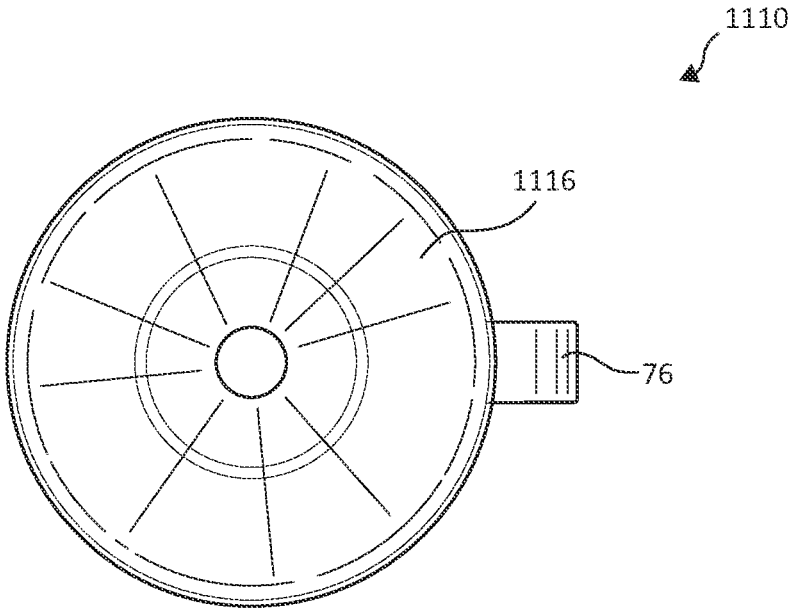
FIG. 23 is bottom view illustration of the bottle assembly of FIG. 17, according to one embodiment of the present invention.
Figure 24:
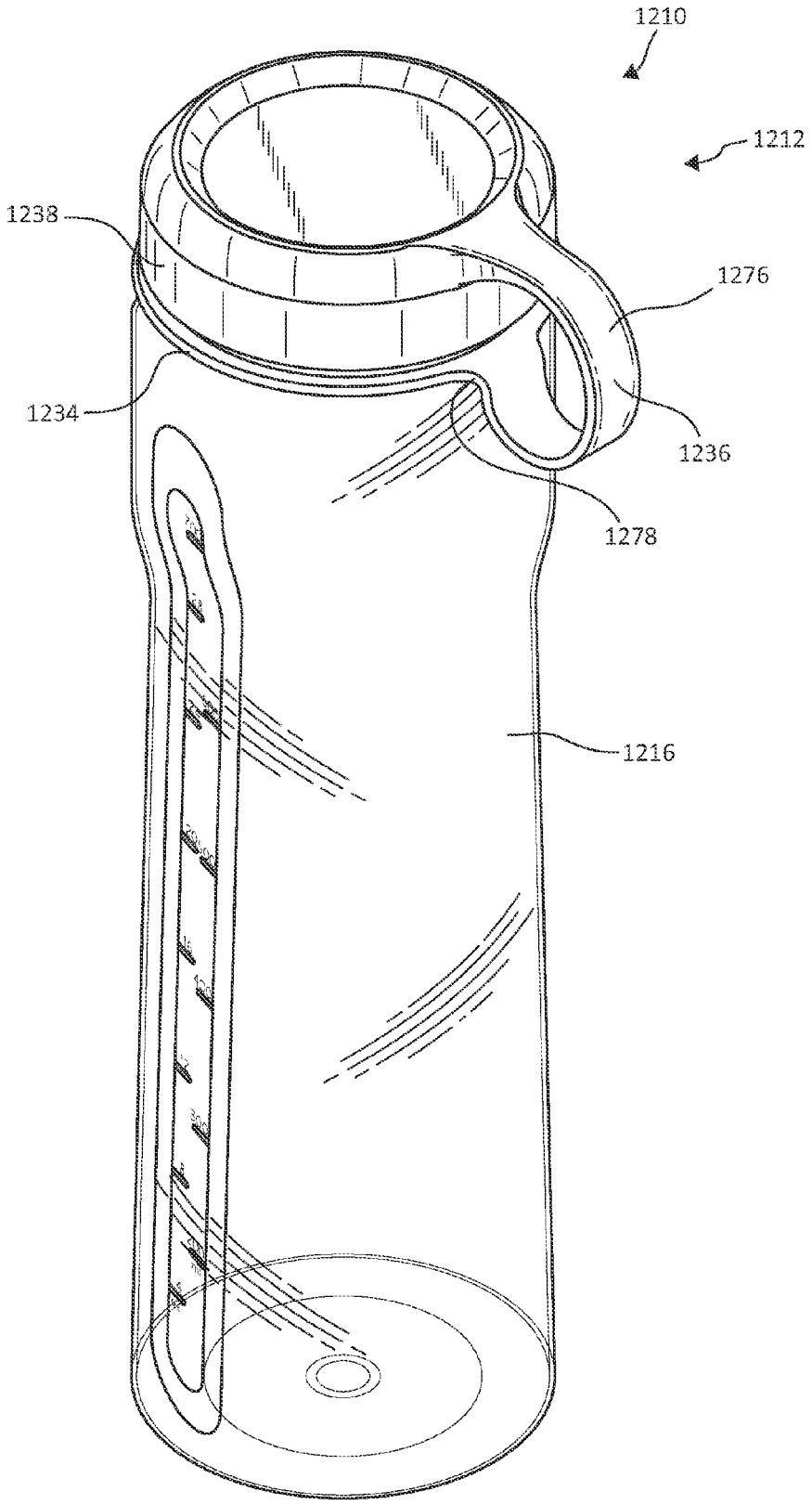
FIG. 24 is a perspective view illustration of a bottle assembly, according to an embodiment of the present invention.
Figure 25:
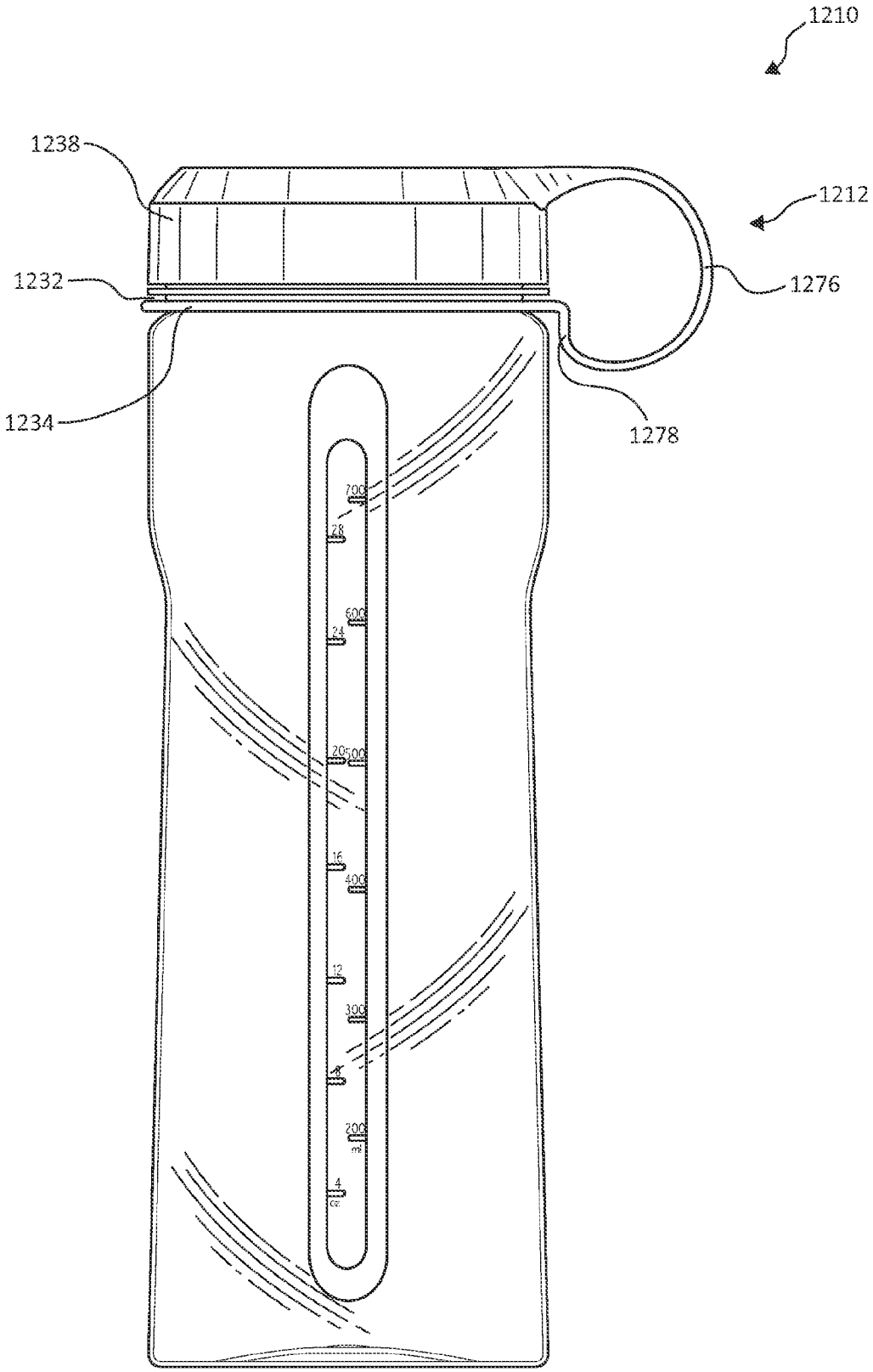
FIG. 25 is a front view illustration of the bottle assembly of FIG. 24, according to one embodiment of the present invention.
Figure 26:
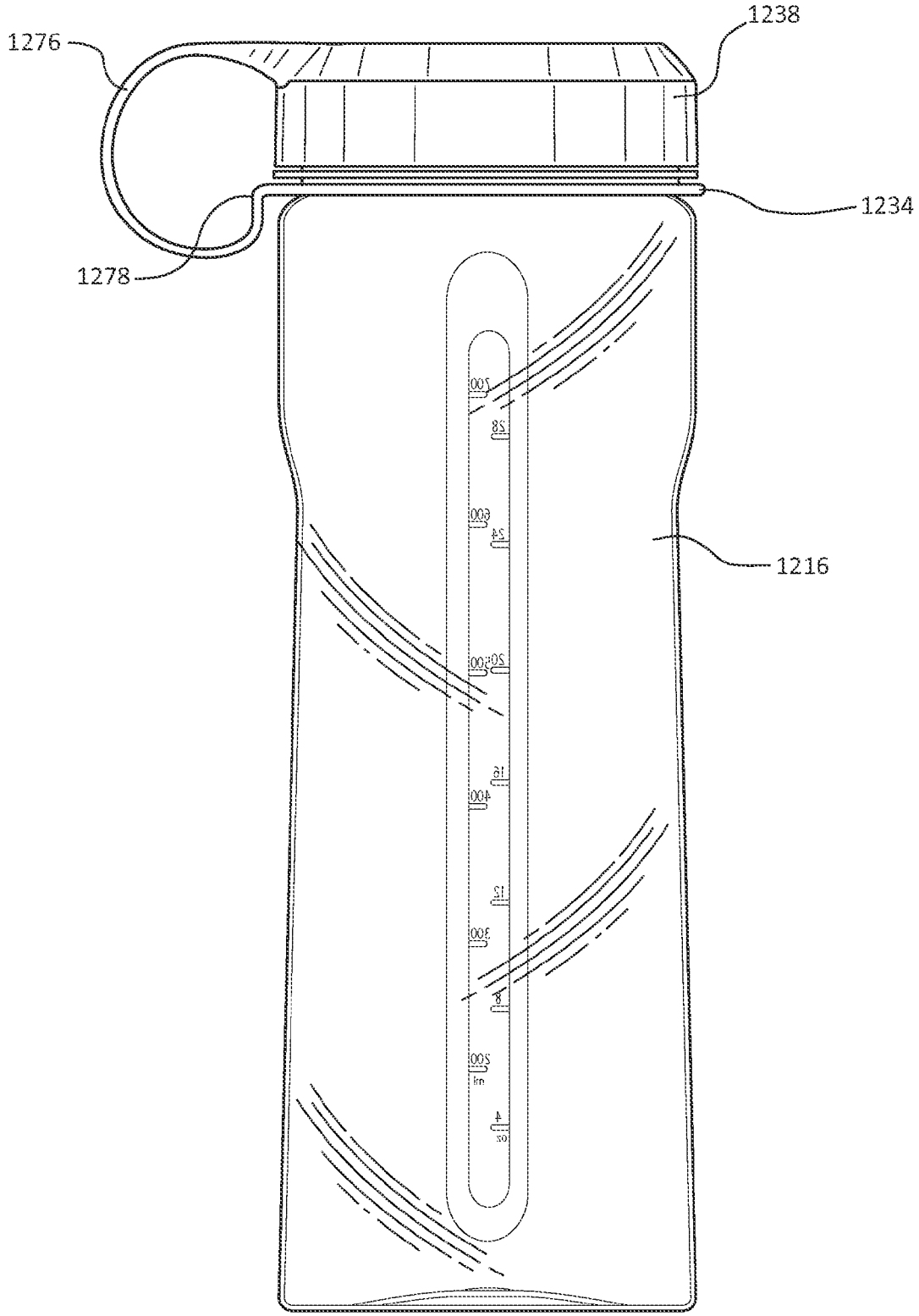
FIG. 26 is a rear view illustration of the bottle assembly of FIG. 24, according to one embodiment of the present invention
Figure 27:
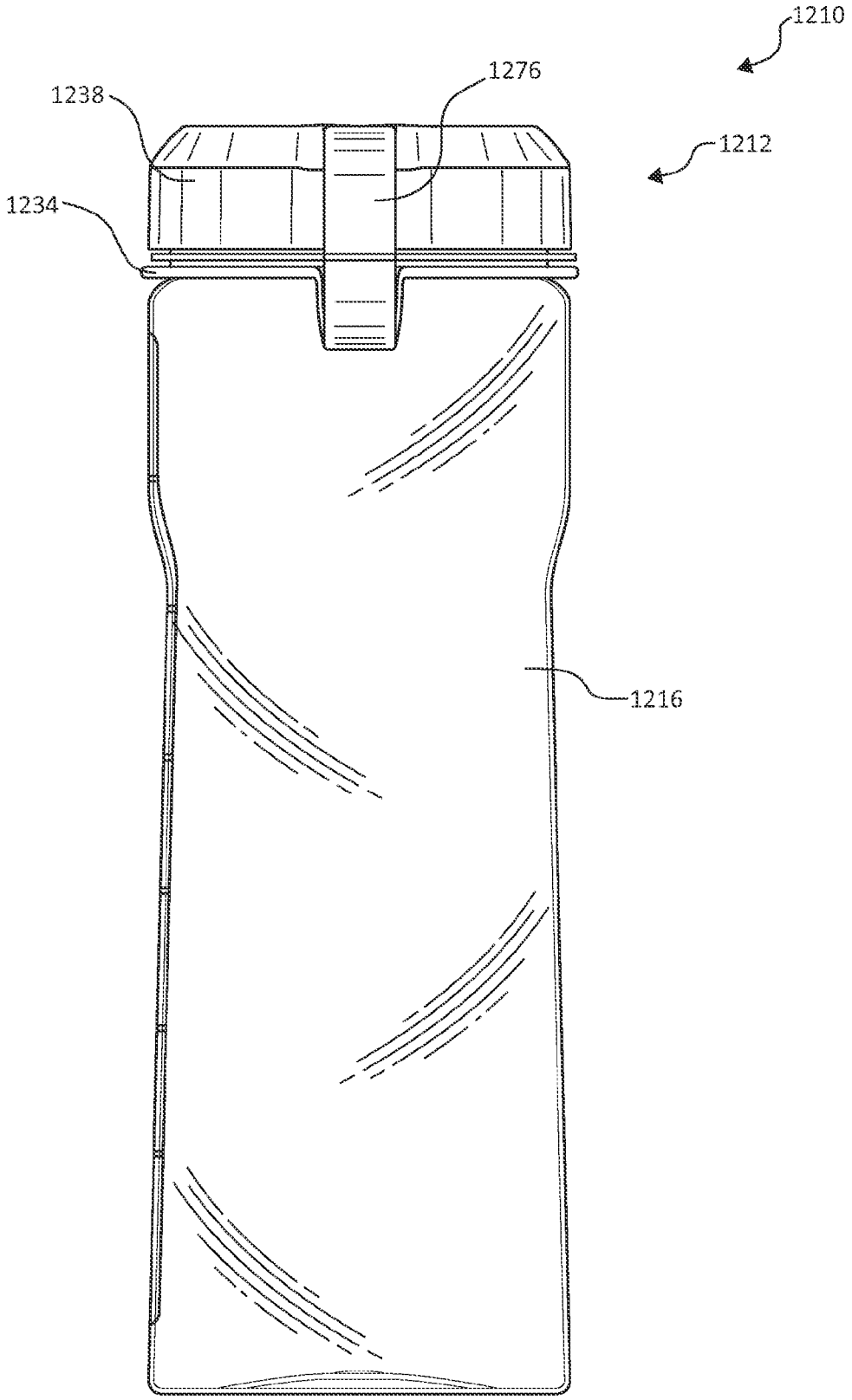
FIG. 27 is a right side view illustration of the bottle assembly of FIG. 24, according to one embodiment of the present invention.
Figure 28:
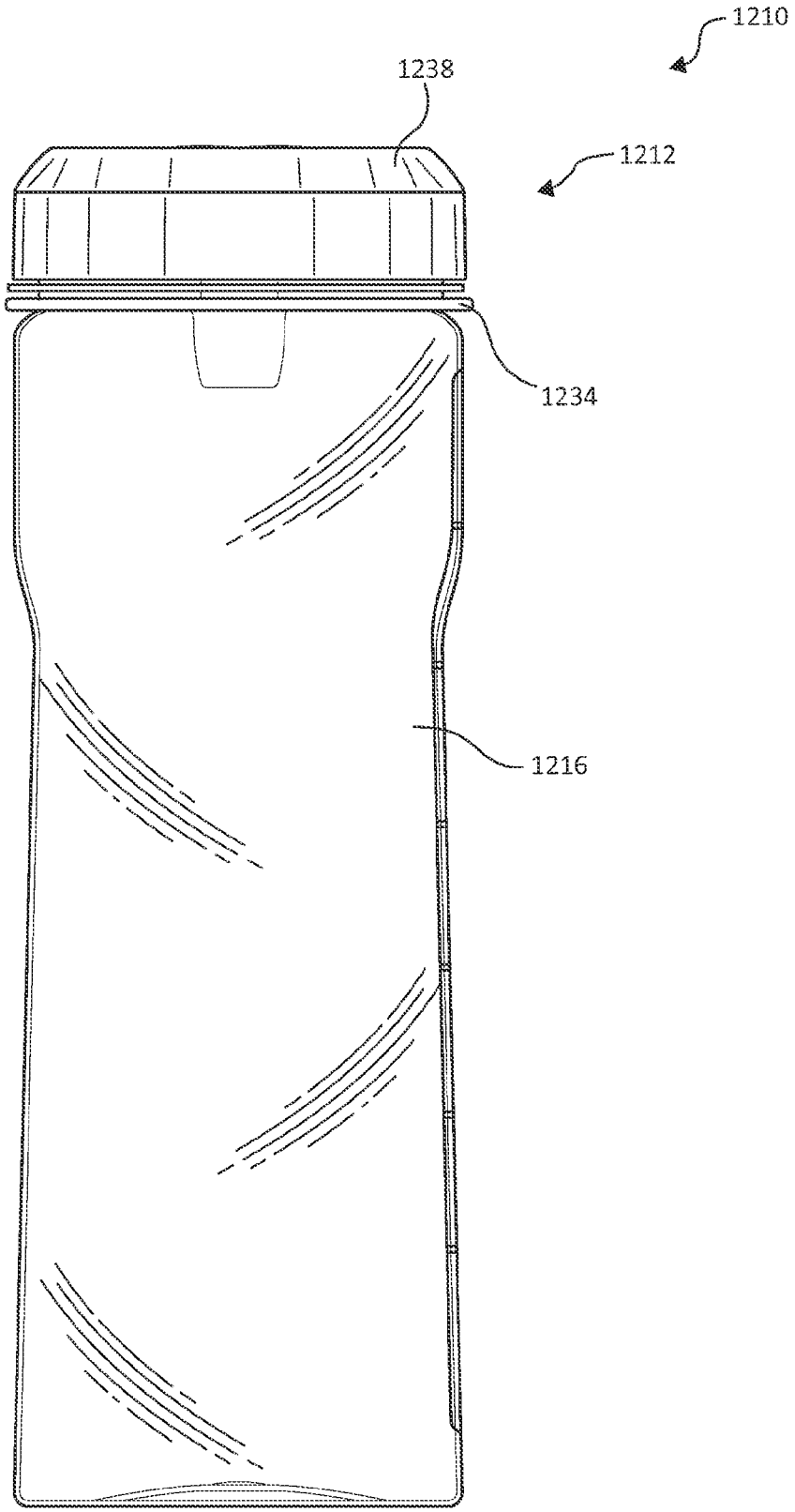
FIG. 28 is a left side view illustration of the bottle assembly of FIG. 24, according to one embodiment of the present invention.
Figure 29:
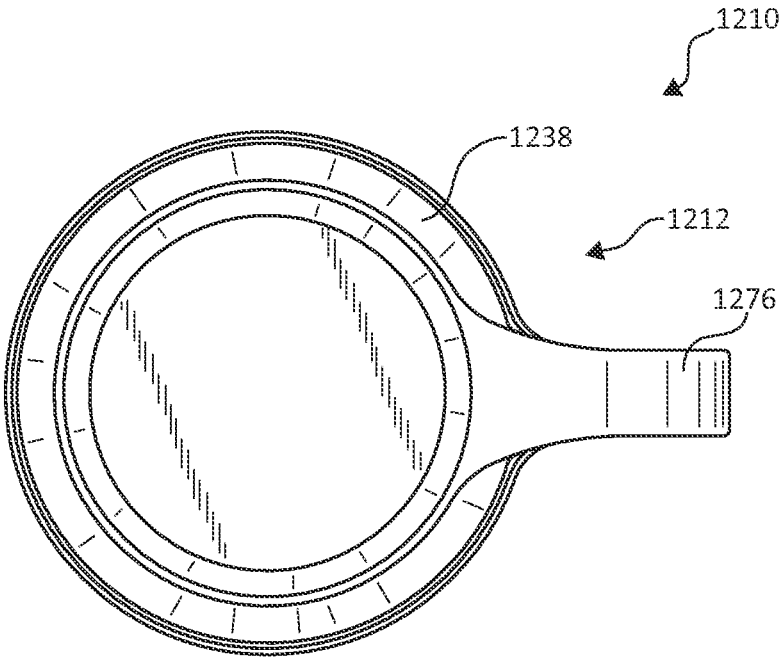
FIG. 29 is a top view illustration of the bottle assembly of FIG. 24, according to one embodiment of the present invention.
Figure 30:
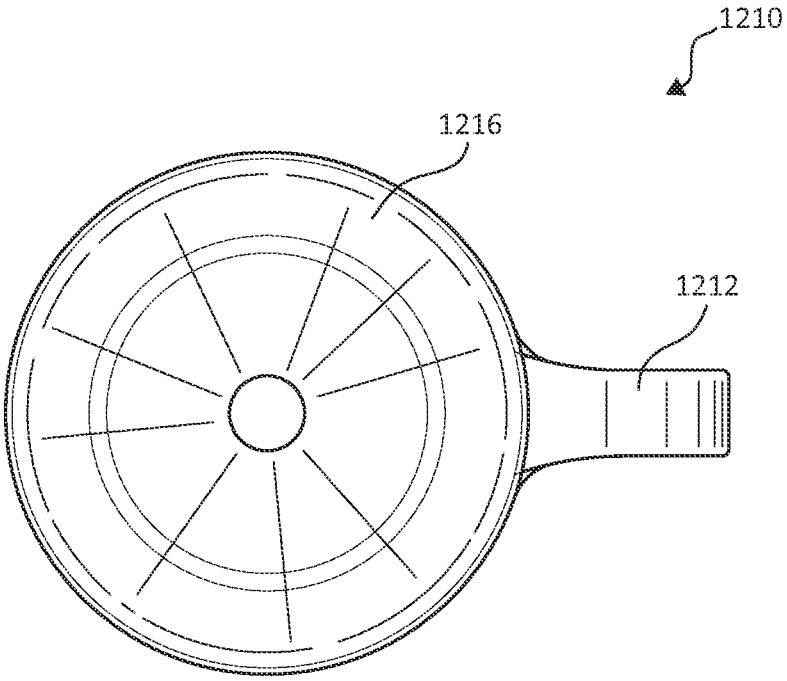
FIG. 30 is bottom view illustration of the bottle assembly of FIG. 24, according to one embodiment of the present invention.
Figure 31:
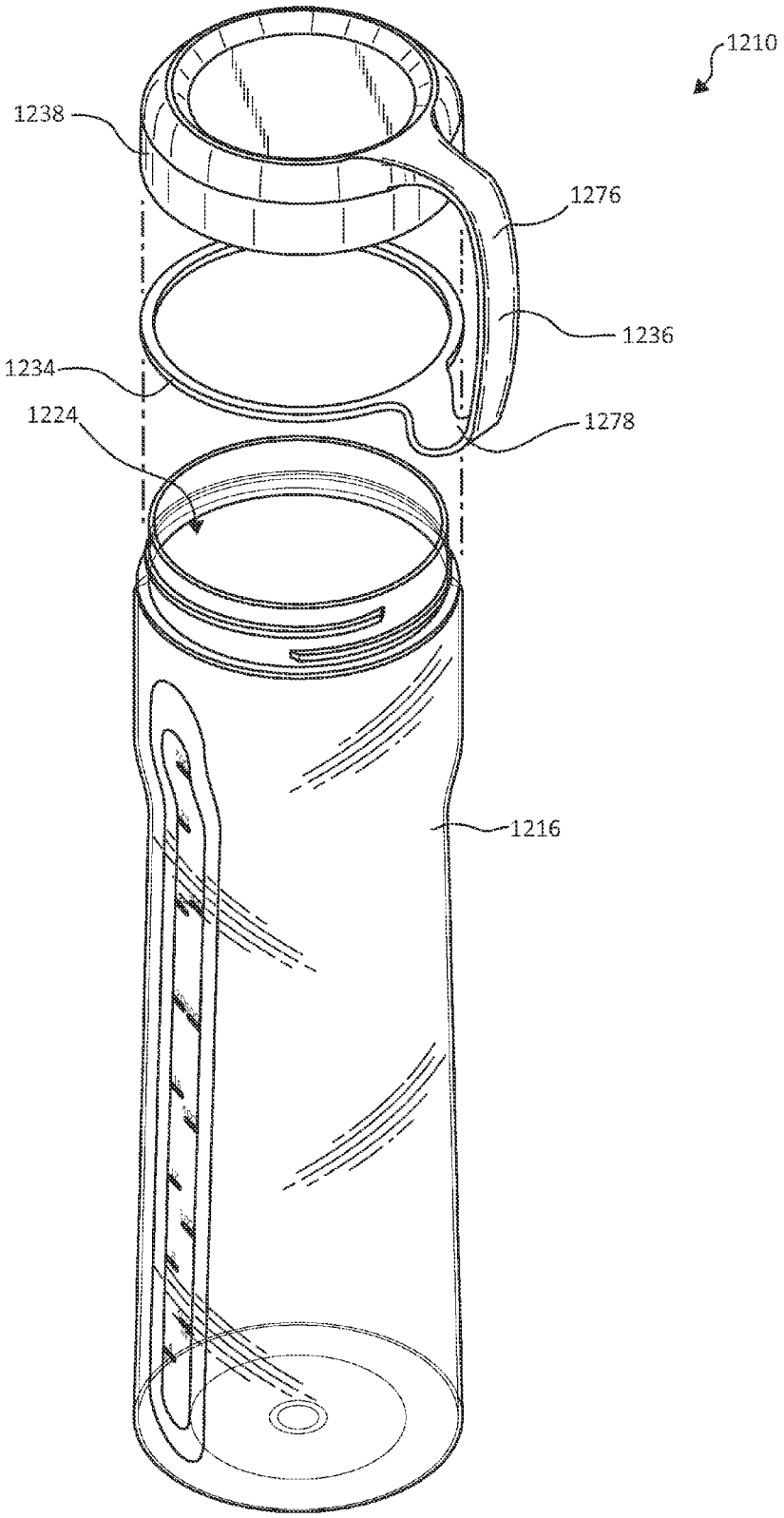
FIG. 31 is an exploded view illustration of the bottle assembly of FIG. 24, according to one embodiment of the present invention.

When desired by a user, at 138, cap 72 is removed from bottle assembly 10, more specifically, from cover 38 as illustrated in FIG. 16. Bottle 16 is tilted or inverted to allow the consumable to be poured out of chamber 25 via spout 42. With reference to FIG. 16, when cap 72 is separated from spout 42 and bottle 16 is elevated to a position above a support surface and tilted away from vertical, vessel ring 34 rotates relative to bottle 16 due to the weight of cap 72 to hang downwardly. For example, cap 72 and strap 76 are positioned below bottle 16 (e.g., at a location between bottle 16 and the support surface). When the user twists her wrist while holding bottle 16, strap 76 and cap 72 remain at the location below bottle 16 and above support surface (not shown) by allowing bottle 16 to rotate relative to vessel ring 34. In addition, bent portion 78 of molded tether 36 directs molded tether 36 to hang away from spout 42 (e.g., alongside bottle 16 or otherwise bent or angled away from main cover 38). This function of bent portion 78 is illustrated in FIG. 15 as molded tether 36 bows away from the user's face. Thus, when the user drinks from bottle 16, cap 72 is kept away from user's face as opposed to prior art systems in which any cap or cover would hang in a near vertical manner from any vessel ring, thereby, hitting a user in the face during use especially as the tilted angle of the bottle increases when measured from the horizontal. Operations 132, 134, 136, and 138 can be repeatedly performed in a variety of orders as a user continues use of bottle assembly 10.

Although bottle assembly 10 is shown with bottle 16 and bottle cover system 12, other configurations are contemplated as well for similar manufacture and use. For example, turning now to FIGS. 17-23, a bottle assembly 1110 includes bottle cover system 12 removably coupled to a different, for example, a taller bottle 1116. Bottle 1116 is substantially similar to bottle 16, except that an outer diameter of bottle 1116 is less than that of bottle 16 and a height of bottle 1116 is greater than the height of bottle 16. Bottle cover system 12 is identical is as described above, but scaled down to a size more suitable for accommodating bottle 1116.

With reference to FIGS. 24-31, another bottle assembly 1210 is illustrated as having a bottle cover system 1212 configured differently from bottle cover systems 12 and 1112. More particularly, bottle cover system 1212 is formed as a unitary component including a molded tether 1236 and cover 1238 and is used with a bottle 1216 configured substantially as described above for bottle 16. Molded tether 1236 includes a vessel ring 1234, a strap 1276, and a bent portion 1278 coupled to and a cover 1238. In this embodiment, vessel ring 1234, strap 1276, and bent portion 1278 remain substantially as described above for vessel ring 34, strap 76, and bent portion 78 except where differences are specifically enumerated herein. As such, vessel ring 1234 is configured to couple with bottle 1112 in a manner substantially identical to how vessel ring 34 couples with bottle 12.

Cover 1238 differs from cover 38 as it does not include spout 42 or interface with cap 72, but instead independently covers an opening 1224 (FIG. 31) of bottle 1216. Strap 1276 couples directly and statically with cover 1238 rather than via any cap ring 74. In one embodiment, cover 1238 is injection molded as a single piece with vessel ring 1234 and strap 1276, while, in other examples, cover 1238 is separately formed and coupled to strap 1276. In another embodiment (not shown), cover 1238 includes a spout similar, for example, to spout 42 described above.

Figure 32:
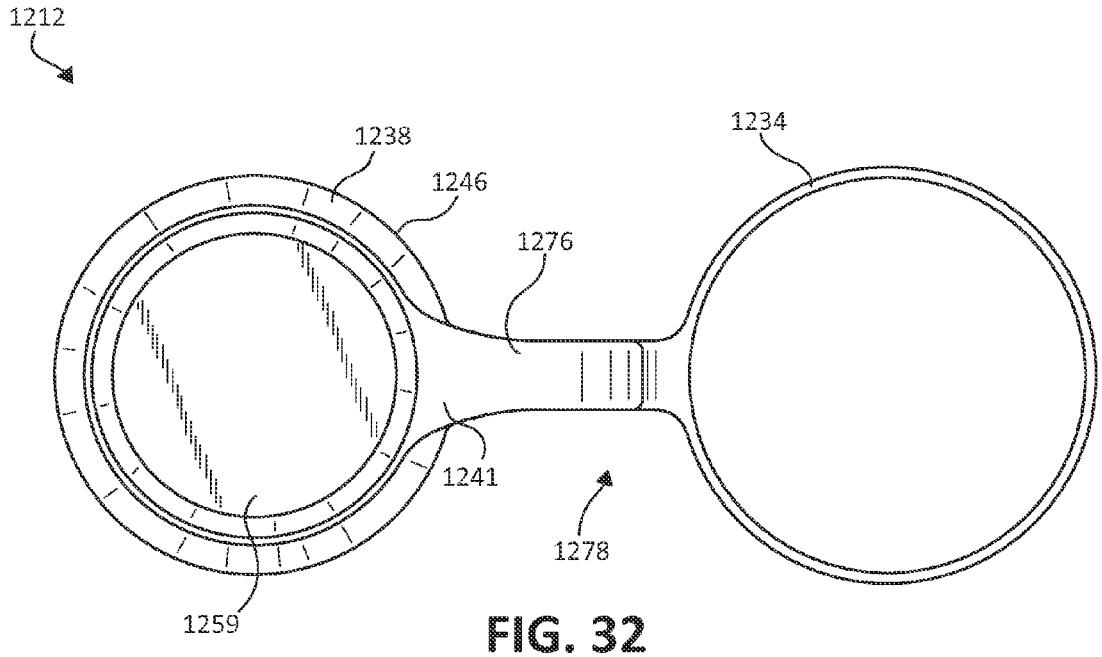
FIG. 32 is a top view illustration of a cover and a tether of the bottle assembly of FIG. 31, according to one embodiment of the present invention.
Figure 33:
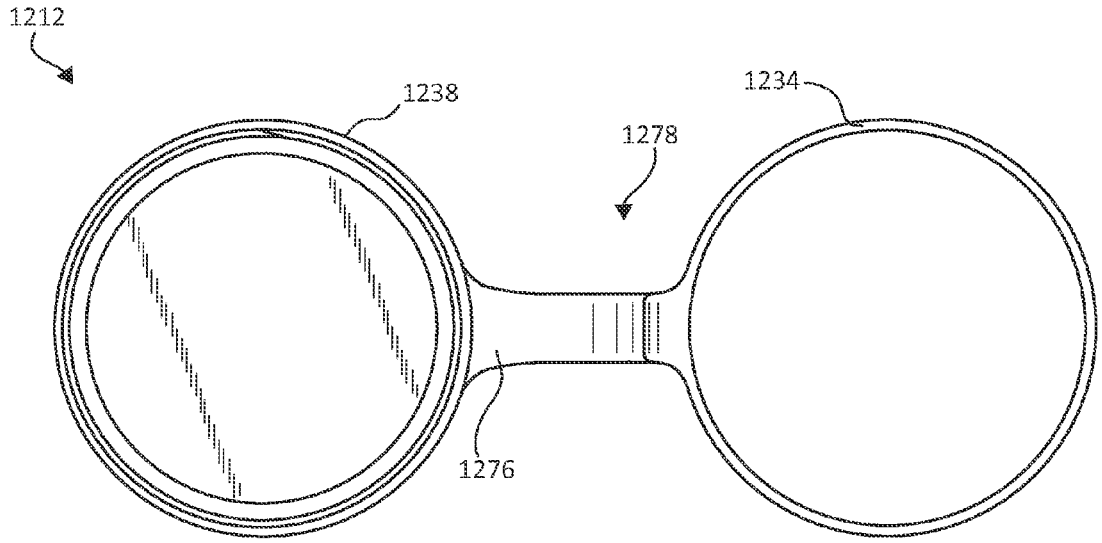
FIG. 33 is a bottom view illustration of the cover and the tether of FIG. 32, according to one embodiment of the present invention.
Figure 34:
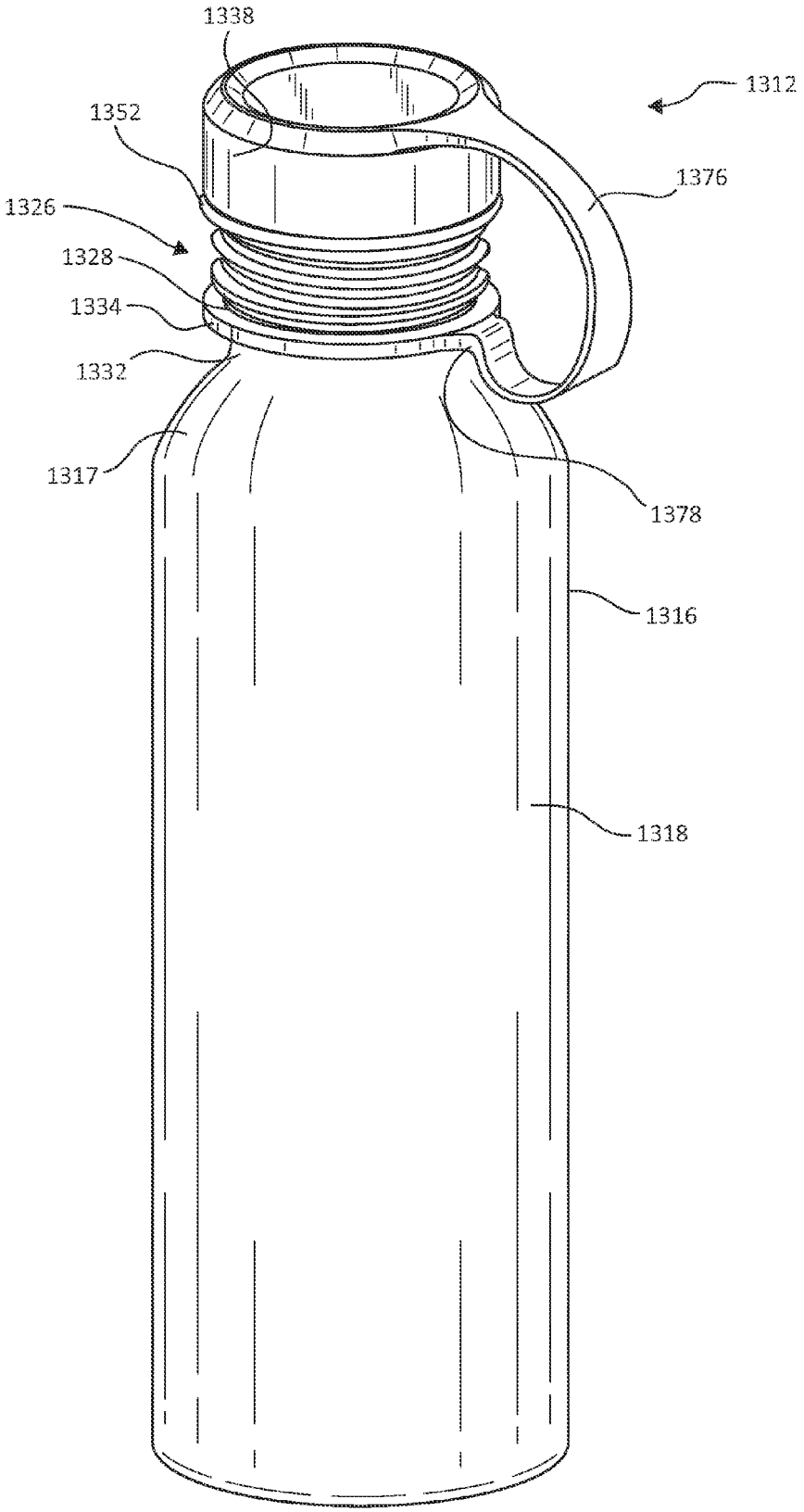
FIG. 34 is a perspective view illustration of a bottle assembly, according to one embodiment of the present invention.
Figure 35:
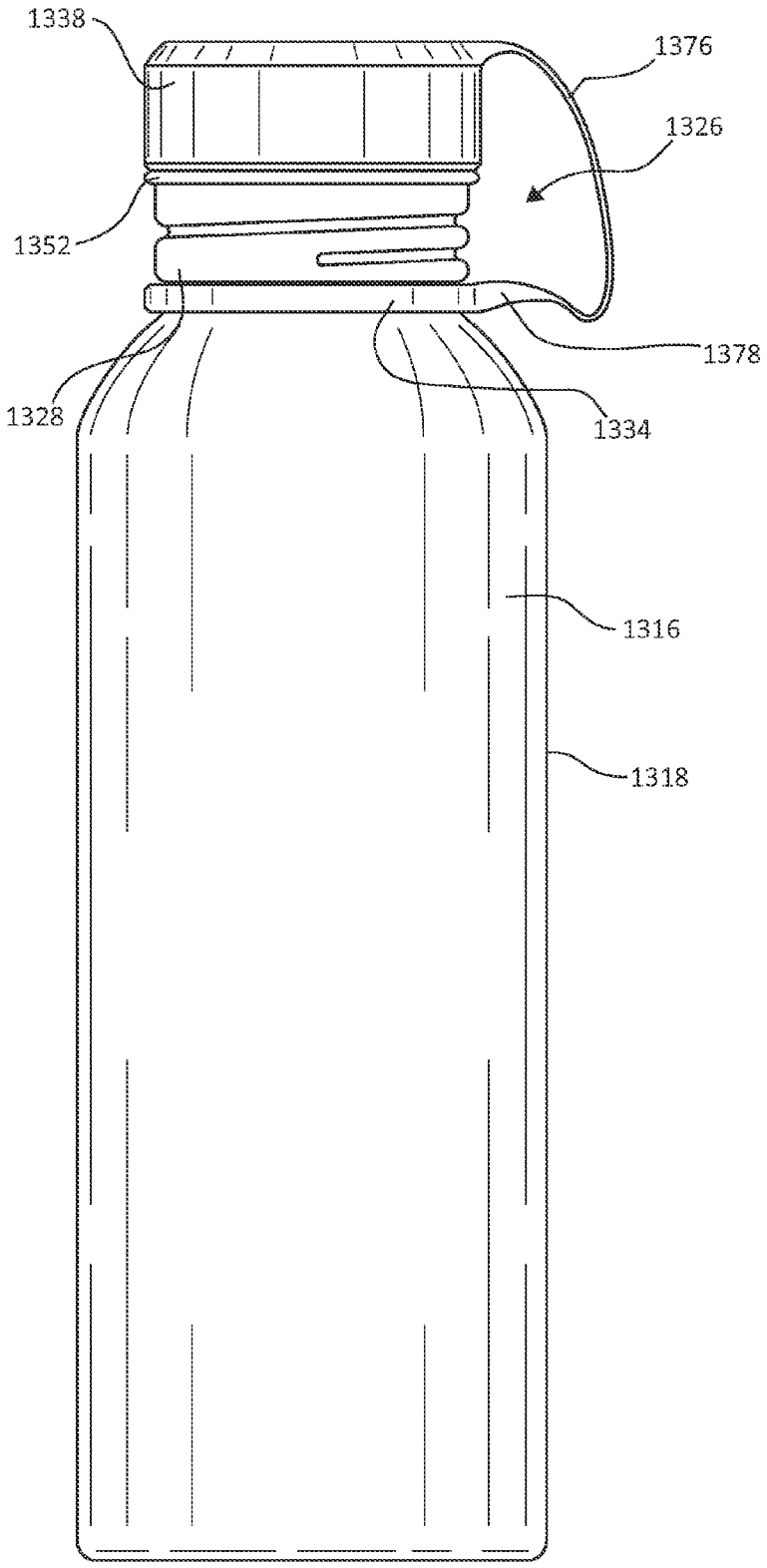
FIG. 35 is a front view illustration of the bottle assembly of FIG. 34, according to one embodiment of the present invention.
Figure 36:
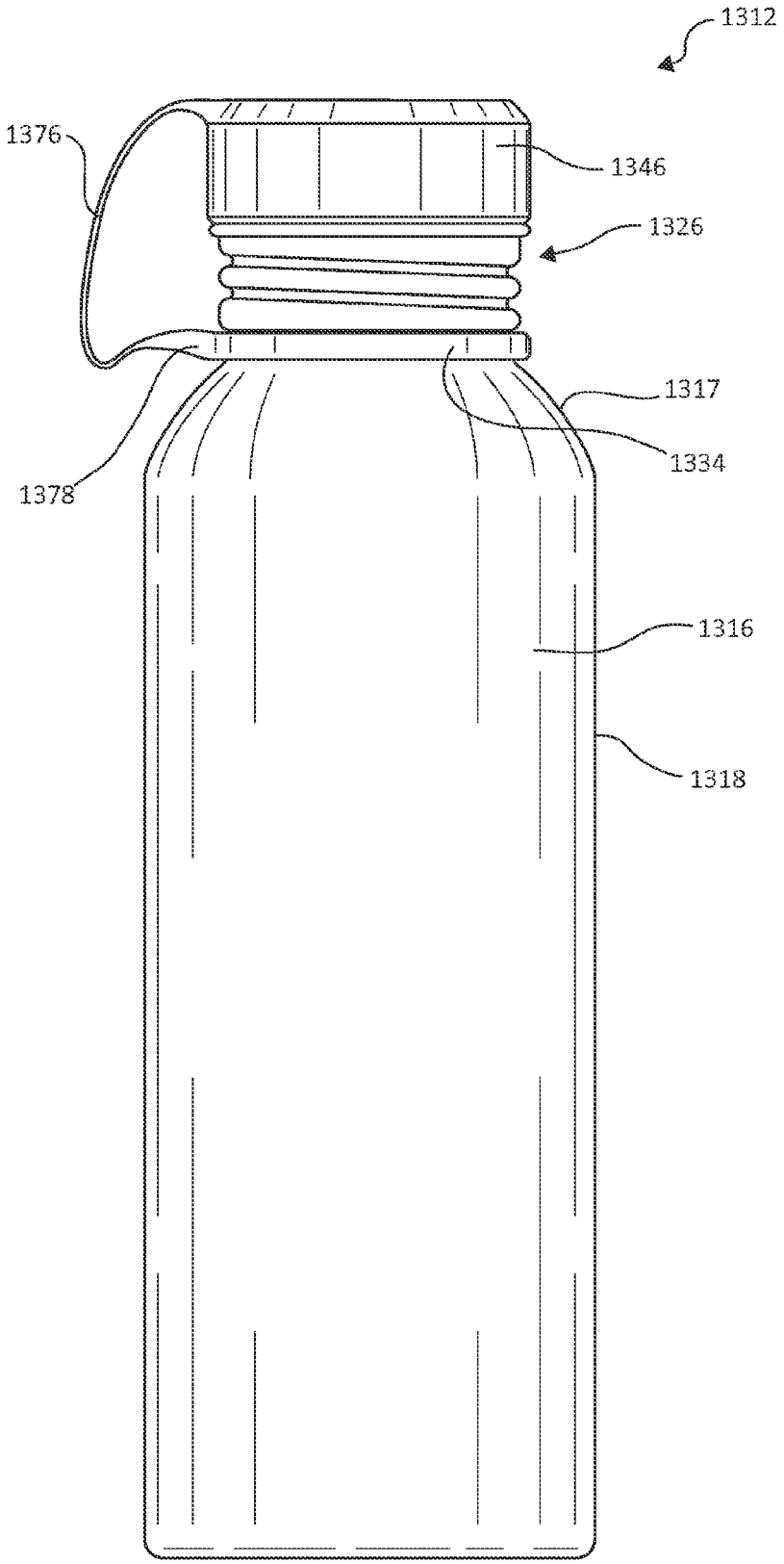
FIG. 36 is a rear view illustration of the bottle assembly of FIG. 34, according to one embodiment of the present invention
Figure 37:
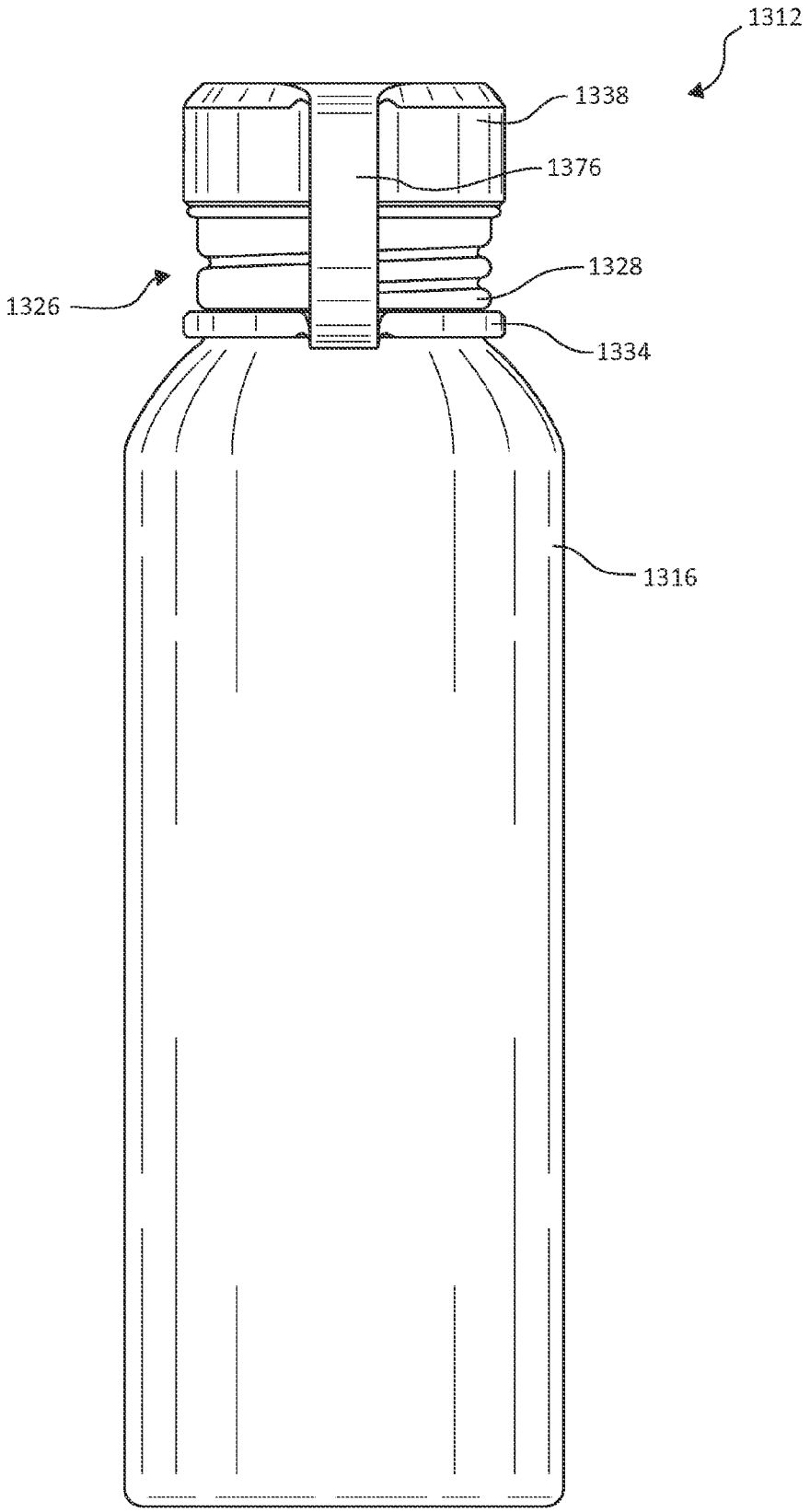
FIG. 37 is a right side view illustration of the bottle assembly of FIG. 34, according to one embodiment of the present invention.
Figure 38:
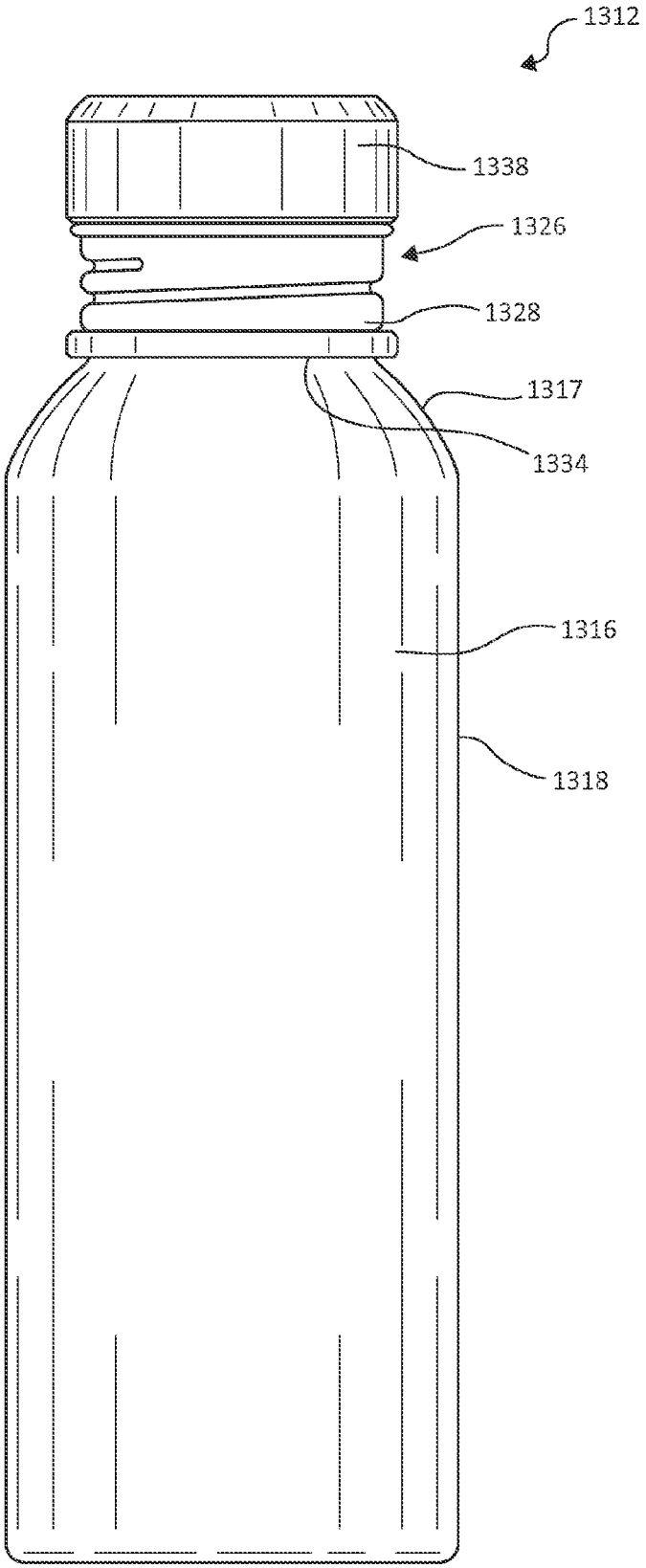
FIG. 38 is a left side view illustration of the bottle assembly of FIG. 34, according to one embodiment of the present invention.
Figure 39:
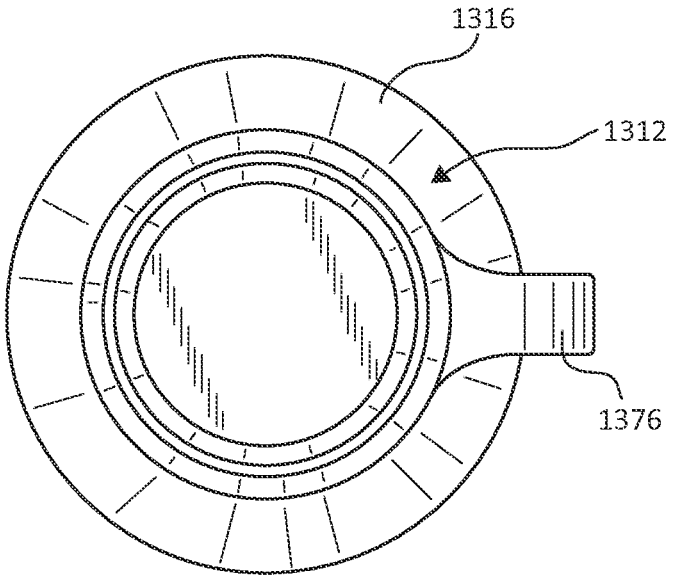
FIG. 39 is a top view illustration of the bottle assembly of FIG. 34, according to one embodiment of the present invention.
Figure 40:
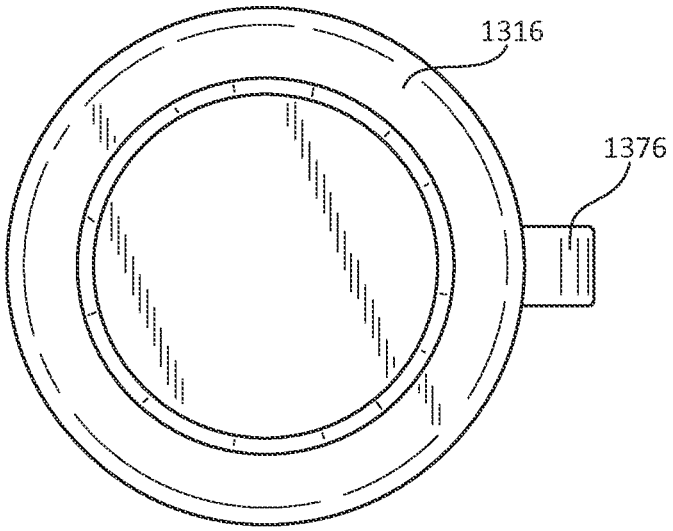
FIG. 40 is bottom view illustration of the bottle assembly of FIG. 34, according to one embodiment of the present invention.

Strap 1276 is coupled to vessel ring 1236 via a bent portion 1278 that is substantially identical to bent portion 78. The stiff nature and the configuration of bent portion 1278 causes an adjacent portion of strap 1276 to be naturally biased at an angle extending radially away from vessel ring 1234, and accordingly bottle cover system 1212 offers similar advantages as described above for bottle cover system 12. Bottle cover assembly 1210 is additionally illustrated without bottle 1216 in FIGS. 32 and 33.

Figure 41:
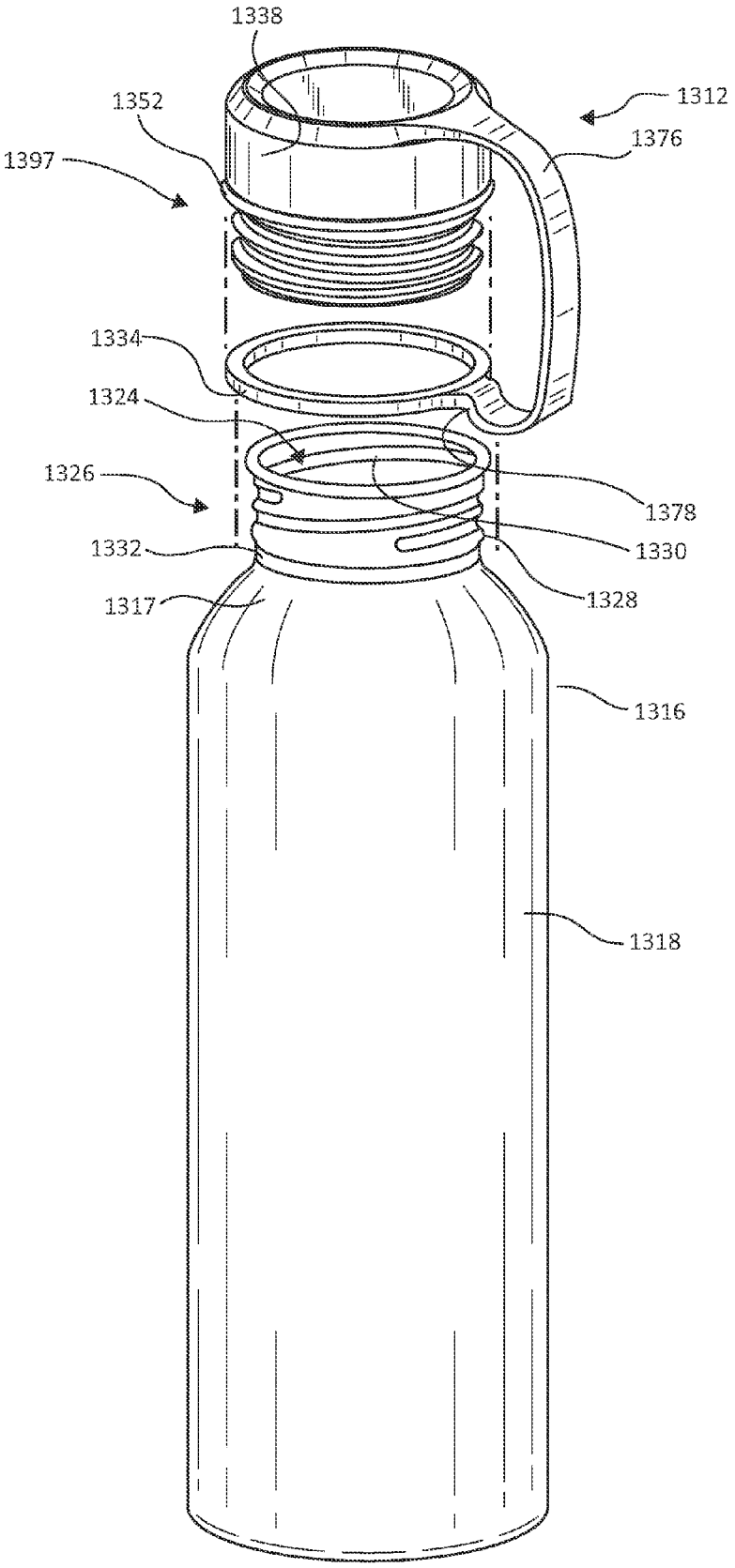
FIG. 41 is an exploded view illustration of the bottle assembly of FIG. 34, according to one embodiment of the present invention.

The particulars of bottle cover system 1212 (or bottle system 12) can be adjusted as necessary to be used in conjunction with a differently configured bottle, alternatively, as will be apparent to those of skill in the art upon reading this application. For example, as illustrated in FIGS. 34-41, a bottle 1316 includes a main body 1318 extending upwardly and transitioning to a neck section 1326 thereof via a tapered top section 1317. A retention lip 1328 is formed just above tapered top section 1317 to provide a channel 1332 therebetween for receiving vessel ring 1334, described below. An annular flange 1352 is configured to form a leak-tight seal with cover 1338, described below. An inner surface of neck section 1326 of bottle 1316 includes threading 1330 (FIG. 41).

Bottle cover system 1312 is, in one embodiment, used with bottle 1316. Bottle cover system 1312 is configured substantially similar to bottle cover system 1212, except that a cover 1338 has a threaded stem 1397 (FIG. 41) for insertion into an opening 1324 of a bottle 1316 to interface with interior threading 1330 of bottle 1216. Accordingly, bottle cover system 1312 includes a vessel ring 1334, a strap 1376 extending therefrom, a bent portion 1378, and cover 1338 including stem 1397, as noted above. Vessel ring 1334 is formed substantially similarly to vessel ring 1234, strap 1376 is formed substantially similarly to strap 1276, and bent portion 1378 is formed substantially similarly to bent portion 1278. Accordingly, regardless of the method of interface between cover 1338 and bottle 1316, due to the inclusion of bent portion 1378, bottle cover system 1312 provides similar advantages as described above for bottle cover systems 12 and 1212.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A molded tether for coupling a cover to a bottle, the molded tether comprising:

a primary ring configured to be attached to a neck of the bottle;

a flexible strap configured to be coupled to the cover; and a bent portion extending from the primary ring and coupling the primary ring to the flexible strap, the bent portion having a higher level of rigidity than the flexible strap, and the bent portion including a flange and a depending tab;

wherein:

the flange extends radially outwardly from the primary ring, the depending tab extends from an end of the flange opposite the primary ring at a downwardly extending angle away from a plane containing the primary ring and toward the flexible strap, and when the molded tether is coupled to the bottle and the cover is removed from the bottle, the strap hangs from the primary ring with an initially non-vertical orientation due to the bent portion.

2. The molded tether of claim 1, wherein the downwardly extending angle is between about 45° and about 135° as measured from the primary ring.

3. The molded tether of claim 1, wherein the flange is formed of a material thickness that is substantially equal to a material thickness of the primary ring.

4. The molded tether of claim 1, wherein the flange of the bent portion is substantially coplanar with the primary ring.

5. The molded tether of claim 1, wherein the bent portion biases the flexible strap to hang at least partially radially outwardly from the primary ring.

6. The molded tether of claim 1, wherein the flexible strap is thinner than the flange of the bent portion.

7. The molded tether of claim 1, wherein the molded tether is formed as a single piece.

8. The molded tether of claim 1, wherein the bent portion has a higher rigidity than the primary ring.

9. The molded tether of claim 1, wherein:

the flexible strap defines an end opposite the primary ring, the molded tether further comprises a secondary ring extending from the end of the flexible strap, and the secondary ring is configured to removably attach to the cover.

10. The molded tether of claim 1, wherein the flexible strap has a substantially identical width as compared with the bent portion.

11. A vessel assembly comprising:

a vessel having an opening;

a cover configured to be selectively coupled to the vessel in a manner extending over the opening of the vessel; and a single-piece tether including:

a primary ring coupled to the vessel about the opening, a substantially rigid L-shaped feature extending radially outwardly from the primary ring and downwardly away from the opening, and a strap extending from the substantially rigid L-shaped feature opposite the primary ring, wherein the strap is coupled to the cover, and the strap is more flexible than the substantially rigid L-shaped feature.

12. The vessel assembly of claim 11, wherein the L-shaped feature includes a first planar leg extending from and residing in the same plane as the primary ring.

13. The vessel assembly of claim 12, wherein the substantially rigid L-shaped feature further includes a second planar leg extending from an end of the first planar leg opposite the primary ring and in a direction substantially perpendicular to the first planar leg, and the second planar leg is thinner than the first planar leg.

14. The vessel assembly of claim 12, wherein the first planar leg has a thickness substantially identical to a thickness of the primary ring, and the first planar leg extends radially outwardly from an outer perimeter of the primary ring.

15. The vessel assembly of claim 11, wherein the primary ring has a thickness that is greater than a thickness of the strap.

16. The vessel assembly of claim 11, wherein the single-piece tether includes a second ring extending from an end of the strap opposite the substantially L-shaped feature and initially formed to be coplanarly positioned with the strap.

* * * * *